US010738628B2

(12) United States Patent
Underwood et al.

(10) Patent No.: US 10,738,628 B2
(45) Date of Patent: Aug. 11, 2020

(54) JOINT FOR BAND FEATURES ON TURBINE NOZZLE AND FABRICATION

(71) Applicant: General Electric Company, Schenectady, NY (US)

(72) Inventors: Sara Saxton Underwood, Schenectady, NY (US); Douglas Glenn Decesare, Queensbury, NY (US); Michael Ray Tuertscher, Fairfield, OH (US); Daniel Gene Dunn, Guilderland, NY (US); Douglas Melton Carper, Trenton, OH (US); Brian Gregg Feie, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 204 days.

(21) Appl. No.: 15/989,952

(22) Filed: May 25, 2018

(65) Prior Publication Data

US 2019/0360346 A1 Nov. 28, 2019

(51) Int. Cl.
*F01D 9/04* (2006.01)
*F01D 25/00* (2006.01)

(52) U.S. Cl.
CPC ..... *F01D 9/04* (2013.01); *F01D 25/005* (2013.01); *F05D 2220/323* (2013.01);
(Continued)

(58) Field of Classification Search
CPC .. F01D 9/04; F05D 2230/60; F05D 2240/128; F05D 2300/6033; F05D 2300/6034; F05D 2260/36; F05D 2240/11
See application file for complete search history.

(56) References Cited

U.S. PATENT DOCUMENTS 1,516,607 A * 11/1924 Johanson ..... F01D 5/18 416/232
1,884,252 A * 10/1932 Robinson ..... F01D 5/025 416/244 R (Continued)

FOREIGN PATENT DOCUMENTS

| | | | |
|---|---|---|---|
| CN | 105538747 | B | 1/2018 |
| DE | 102016207863 | A1 | 11/2017 |
| JP | 2009143173 | A | 7/2009 |

OTHER PUBLICATIONS

Messier, Robert; "Joining of Materials and Structures From Pragmatic Process to Enabling Technology"; Copyright 2004 Elsevier Inc Chapter 3, pp. 161-163 (Year: 2004).*

(Continued)

*Primary Examiner* — Moshe Wilensky
*Assistant Examiner* — Brian Christopher Delrue
(74) *Attorney, Agent, or Firm* — General Electric Company; Kristi L. Davidson

(57) ABSTRACT

A ceramic matrix composite (CMC) component including a subcomponent, such as a band flowpath, a load bearing wall and a wall support, each comprised of a ceramic matrix composite (CMC) including reinforcing fibers embedded in a matrix. The CMC component further including at least one mechanical joint joining the subcomponent, the load bearing wall and the wall support to form the CMC component. The reinforcing fibers of the load bearing wall are oriented substantially normal to the reinforcing fibers of the subcomponent and the wall support. Methods are also provided for joining the subcomponent, the load bearing wall and the wall support to form a mechanical joint.

23 Claims, 12 Drawing Sheets

(52) U.S. Cl.
CPC .... *F05D 2230/60* (2013.01); *F05D 2240/128* (2013.01); *F05D 2300/6033* (2013.01); *F05D 2300/6034* (2013.01)

(56) References Cited

U.S. PATENT DOCUMENTS 3,410,441 A * 11/1968 Rhyne ..... A47B 88/941 220/4.28
4,083,464 A * 4/1978 Burnett ..... B65D 7/24 217/13
4,256,533 A * 3/1981 Mayer ..... C03C 15/00 156/101
4,363,602 A * 12/1982 Martin ..... F01D 5/282 416/230
4,407,635 A * 10/1983 Grimes ..... B64C 11/26 416/230
4,410,385 A * 10/1983 Murphy ..... D06M 23/06 156/181
4,492,153 A * 1/1985 Grabowski ..... B65D 11/1873 206/508
4,507,011 A 3/1985 Brown
4,613,473 A * 9/1986 Layden ..... C03B 37/15 156/89.26
5,022,824 A * 6/1991 Violette ..... B64C 11/008 416/230
5,161,300 A * 11/1992 Nanjyo ..... G11B 5/295 156/268
5,506,018 A * 4/1996 Jacob ..... B29C 37/0082 428/113
5,639,535 A * 6/1997 McCarville ..... B29C 70/30 428/119
5,650,229 A * 7/1997 Gross ..... B29B 11/06 428/113
5,672,417 A * 9/1997 Champenois ..... F01D 5/282 416/230
5,728,445 A * 3/1998 Murakami ..... B32B 18/00 264/640
5,862,975 A 1/1999 Chldress
6,315,519 B1 * 11/2001 Bagepalli ..... F01D 11/08 415/135
6,439,844 B1 5/2002 Turnquist et al.
6,648,597 B1 * 11/2003 Widrig ..... C04B 37/001 415/200
6,758,653 B2 * 7/2004 Morrison ..... F01D 9/04 415/116
7,229,513 B2 6/2007 Keith et al.
7,312,274 B2 * 12/2007 Millard ..... B32B 18/00 524/430
7,510,379 B2 * 3/2009 Marusko ..... F01D 5/282 29/889.7
7,802,799 B1 9/2010 Semmes
7,837,148 B2 11/2010 Kismarton et al.
7,887,249 B2 * 2/2011 Schmitz ..... B64C 9/02 403/364
7,963,038 B2 6/2011 Schmitz
8,181,345 B2 8/2012 Carpenter et al.
8,235,670 B2 * 8/2012 Morrison ..... F01D 5/147 29/889.72
8,297,931 B2 * 10/2012 Read ..... F01D 11/008 416/215
8,309,197 B2 * 11/2012 Davis ..... B32B 3/30 415/174.4
8,398,374 B2 * 3/2013 Roberts ..... F01D 5/147 416/193 R
8,435,007 B2 * 5/2013 Morrison ..... F23M 5/04 416/193 A
8,496,443 B2 * 7/2013 Campbell ..... F01D 5/081 416/248
8,545,744 B2 10/2013 Jones
8,616,801 B2 * 12/2013 Morrison ..... C04B 35/80 403/205
8,851,853 B2 * 10/2014 Alvanos ..... F01D 5/225 416/220 R
8,961,059 B2 2/2015 Reeves et al.
9,017,033 B2 * 4/2015 Brown ..... F01D 11/008 416/193 A
9,039,358 B2 * 5/2015 Tholen ..... F01D 11/12 415/173.3
9,102,103 B2 8/2015 Fox et al.
9,114,588 B2 8/2015 Defner
9,132,619 B2 * 9/2015 Khalifa ..... B32B 37/16
9,149,997 B2 10/2015 Foster et al.
9,151,166 B2 * 10/2015 Uskert ..... F01D 5/225
9,168,702 B2 10/2015 Eli-Eli et al.
9,267,388 B2 * 2/2016 Mizokami ..... F01D 9/04
9,291,060 B2 * 3/2016 Lazur ..... F01D 5/147
9,327,446 B2 5/2016 Clark et al.
9,440,888 B2 * 9/2016 Bouillon ..... C04B 41/009
9,511,446 B2 12/2016 Kandasamy et al.
9,527,262 B2 * 12/2016 Zhang ..... C04B 37/025
9,555,587 B2 1/2017 Konez
9,587,517 B2 * 3/2017 Vetters ..... F01D 11/18
9,623,955 B2 * 4/2017 Trautmann ..... B64C 1/00
9,731,807 B2 8/2017 Beumier
9,738,373 B2 8/2017 Guillemaut et al.
9,759,079 B2 * 9/2017 Sippel ..... F01D 5/225
9,862,175 B2 1/2018 Matsen et al.
9,945,256 B2 * 4/2018 Freeman ..... F01D 11/12
9,970,310 B2 * 5/2018 McCaffrey ..... F01D 11/08
10,253,639 B2 * 4/2019 Sippel ..... F01D 9/041
2003/0156944 A1 * 8/2003 Rust ..... B64C 11/26 416/204 R
2004/0062639 A1 * 4/2004 Glynn ..... F02C 7/20 415/134
2004/0101358 A1 * 5/2004 Odorico ..... F16B 12/52 403/403
2005/0084379 A1 * 4/2005 Schreiber ..... B23H 3/04 416/230
2005/0158171 A1 * 7/2005 Carper ..... C04B 35/565 415/200
2005/0254942 A1 * 11/2005 Morrison ..... C04B 37/005 415/200
2006/0140771 A1 * 6/2006 Carper ..... C04B 35/62871 416/241 R
2006/0249912 A1 * 11/2006 Wilson, Jr. ..... F16J 15/442 277/409
2007/0258809 A1 * 11/2007 Mazzola ..... F16J 15/104 415/173.1
2008/0025838 A1 * 1/2008 Marini ..... F01D 25/246 415/173.4
2008/0087021 A1 * 4/2008 Radonovich ..... F01D 11/122 60/752
2008/0124512 A1 * 5/2008 Steibel ..... C04B 35/573 428/105
2009/0010755 A1 * 1/2009 Keller ..... F01D 21/045 415/197
2009/0081033 A1 * 3/2009 Schiavo ..... F01D 11/08 415/200
2009/0208322 A1 * 8/2009 McCaffrey ..... F01D 11/125 415/113
2009/0252907 A1 * 10/2009 Keller ..... B32B 18/00 428/34.6
2009/0324393 A1 * 12/2009 Gonzalez ..... F01D 11/08 415/170.1
2010/0015394 A1 * 1/2010 Morrison ..... C04B 35/6269 428/137
2010/0104426 A1 * 4/2010 Keller ..... F01D 11/12 415/173.1
2010/0251721 A1 * 10/2010 Morrison ..... F01D 5/147 60/753
2011/0265406 A1 * 11/2011 Morrison ..... C04B 35/806 52/282.3
2012/0237355 A1 * 9/2012 Zhang ..... F01D 5/284 416/226
2013/0004326 A1 * 1/2013 McCaffrey ..... F01D 5/284 416/241 B
2013/0004331 A1 * 1/2013 Beeck ..... F01D 5/147 416/97 R
2013/0011271 A1 * 1/2013 Shi ..... F01D 5/28 416/230

(56) References Cited

U.S. PATENT DOCUMENTS

2013/0156556 A1* 6/2013 Franks ..... F01D 11/08 415/182.1
2015/0044049 A1* 2/2015 Lamusga ..... F01D 11/08 416/182
2015/0129113 A1 5/2015 Griess et al.
2015/0292340 A1* 10/2015 Kawanishi ..... D03D 1/00 416/215
2015/0235314 A1 12/2015 Davidson et al.
2015/0345296 A1* 12/2015 Davidson ..... F01D 5/3007 60/805
2015/0345307 A1* 12/2015 Davidson ..... F01D 5/28 60/805
2016/0003094 A1 1/2016 Renggli et al.
2016/0046084 A1 2/2016 Konez
2016/0146021 A1* 5/2016 Freeman ..... F01D 5/3007 416/95
2016/0177787 A1* 6/2016 Benson ..... F01D 25/243 415/214.1
2016/0230568 A1* 8/2016 Sippel ..... F01D 5/282
2016/0312626 A1* 10/2016 Schetzel ..... F01D 5/147
2016/0312628 A1* 10/2016 Kirby ..... C04B 41/52
2016/0312639 A1* 10/2016 Shapiro ..... F01D 25/12
2016/0325368 A1* 11/2016 Landwehr ..... B23K 1/0056
2016/0333741 A1* 11/2016 Stapleton ..... F01D 25/14
2016/0348521 A1* 12/2016 Sippel ..... F01D 5/225
2016/0376893 A1* 12/2016 Hardwicke ..... F01D 25/246 156/249
2017/0002674 A1* 1/2017 Vetters ..... F01D 25/246
2017/0022833 A1* 1/2017 Heitman ..... F01D 25/243
2017/0058684 A1* 3/2017 Correia ..... F01D 25/005
2017/0100909 A1 4/2017 Georgeson et al.
2017/0107836 A1 4/2017 Roberts et al.
2017/0211403 A1* 7/2017 McCaffrey ..... C04B 35/80
2017/0350268 A1* 12/2017 McCaffrey ..... F01D 11/08
2018/0029944 A1* 2/2018 Subramanian ..... F01D 5/18
2018/0105471 A1* 4/2018 Shi ..... C04B 41/00
2018/0216477 A1* 8/2018 Kittleson ..... F01D 5/284
2018/0230064 A1* 8/2018 Lamusga ..... C04B 35/573
2018/0251921 A1* 9/2018 Shi ..... C22C 47/08
2018/0266261 A1* 9/2018 Overholser ..... C04B 35/803
2018/0340440 A1* 11/2018 Freeman ..... F01D 9/042
2018/0371947 A1* 12/2018 Sippel ..... F01D 11/005
2019/0062890 A1* 2/2019 Flores Renteria ..... C04B 41/52
2019/0084892 A1* 3/2019 Subramanian .... C04B 35/62844
2019/0145270 A1* 5/2019 Dunn ..... F01D 9/04 428/33
2019/0186271 A1* 6/2019 Xu ..... F01D 5/282
2019/0284947 A1* 9/2019 Hock ..... F01D 25/005
2019/0330988 A1* 10/2019 Hillier ..... F01D 25/12
2019/0338660 A1* 11/2019 Underwood ..... F01D 9/041
2019/0390566 A1* 12/2019 Propheter-Hinckley ..... F01D 5/282
2020/0055789 A1* 2/2020 Smyth ..... C04B 35/565
2020/0072078 A1* 3/2020 Decesare ..... B23P 6/005

OTHER PUBLICATIONS

European Patent Office, Extended European Search Report issued in corresponding EP Application No. EP19172369.1 dated Oct. 10, 2019, 8 pages.
Brun, Milivoj K., Formation of Tough Composite Joints, Journal of the American Ceramic Society, Dec. 1998, vol. 81, No. 12, pp. 3307-3312.
Corman, G. S., & Luthra, K. L., Melt Infiltrated Ceramic Composites (HiperComp) for Gas Turbine Engine Applications, Jan. 2006, Continuous Fiber Ceramic Composites Program Phase II Final Report for the Period May 1994-Sep. 2005, Chapter 3.3 Composite Joining, Table of Contents and pp. 97-115.
Dunn, D. et al., "CMC Component and Fabrication Using Mechanical Joints", U.S. Appl. No. 15/810,874, filed Nov. 13, 2017, pp. 1-44.
Hock, M. et al., "CMC Shroud Segment With Interlocking Mechanical Joints and Fabrication", U.S. Appl. No. 15/920,741, filed Mar. 14, 2018, pp. 1-56.
Underwood, S. et al., "CMC Nozzle With Interlocking Mechanical Joint and Fabrication", U.S. Appl. No. 15/969,435, filed May 2, 2018, pp. 1-54.
Feie, B. et al., "Composite Components Having T or L-Joints and Methods for Forming Same", U.S. Appl. No. 15/878,687, filed Jan. 24, 2018, pp. 1-37.

* cited by examiner

JOINT FOR BAND FEATURES ON TURBINE NOZZLE AND FABRICATION

BACKGROUND

The subject matter disclosed herein relates to ceramic matrix composite (CMC) components and the joining of CMC subcomponents to form such components. More particularly, this invention is directed to a portion of a CMC nozzle and method of forming the CMC nozzle from multiple subcomponents utilizing one or more interlocking mechanical joints.

Gas turbine engines feature several components. Air enters the engine and passes through a compressor. The compressed air is routed through one or more combustors. Within a combustor are one or more nozzles that serve to introduce fuel into a stream of air passing through the combustor. The resulting fuel-air mixture is ignited in the combustor by igniters to generate hot, pressurized combustion gases in the range of about 1100° C. to 2000° C. This high energy airflow exiting the combustor is redirected by the first stage turbine nozzle to downstream high and low pressure turbine stages. The turbine section of the gas turbine engine contains a rotor shaft and one or more turbine stages, each having a turbine disk (or rotor) mounted or otherwise carried by the shaft and turbine blades mounted to and radially extending from the periphery of the disk. A turbine assembly typically generates rotating shaft power by expanding the high energy airflow produced by combustion of fuel-air mixture. Gas turbine buckets or blades generally have an airfoil shape designed to convert the thermal and kinetic energy of the flow path gases into mechanical rotation of the rotor. In these stages, the expanded hot gases exert forces upon turbine blades, thus providing additional rotational energy to, for example, drive a power-producing generator.

In advanced gas path (AGP) heat transfer design for gas turbine engines, the high temperature capability of CMCs make it an attractive material from which to fabricate arcuate components such as turbine blades, nozzles and shrouds. Within a turbine engine, a nozzle is comprised of a plurality of vanes, also referred to as blades or airfoils, with each vane, or a plurality of vanes, joined to a plurality of bands, also referred to as platforms.

A number of techniques have been used to manufacture turbine engine components such as the turbine blades, nozzles or shrouds using CMCs. CMC materials generally comprise a ceramic fiber reinforcement material embedded in a ceramic matrix material. The reinforcement material serves as the load-bearing constituent of the CMC in the event of a matrix crack; the ceramic matrix protects the reinforcement material, maintains the orientation of its fibers, and carries load in the absence of matrix cracks. Of particular interest to high-temperature applications, such as in a gas turbine engine, are silicon-based composites. Silicon carbide (SiC)-based CMC materials have been proposed as materials for certain components of gas turbine engines, such as the turbine blades, vanes, combustor liners, nozzles and shrouds. SiC fibers have been used as a reinforcement material for a variety of ceramic matrix materials, including SiC, C, and $Al_2O_3$. Various methods are known for fabricating SiC-based CMC components, including Silicomp, melt infiltration (MI), chemical vapor infiltration (CVI), and polymer infiltration and pyrolysis (PIP). In addition to non-oxide based CMCs such as SiC, there are oxide based CMCs. Though these fabrication techniques significantly differ from each other, each involves the fabrication and densification of a preform to produce a part through a process that includes the application of heat and/or pressure at various processing stages. In many instances, fabrication of complex composite components, such as fabrication of CMC gas turbine nozzles, involves forming fibers over small radii which may lead to challenges in manufacturability. More complex geometries may require complex tooling, complex compaction, etc.

Of particular concern herein are load bearing CMC components, such as turbine nozzle bands, with a focus on load path supports and retainment features of the CMC components, such as mounting supports on turbine nozzle band walls. These features typically require specific orientation of the fibers. More particularly, it is desirable to orient the fibers in the load bearing surfaces normal to the primary load path to provide an adequate wear interface. Some approaches to constructing these features may involve bending fibers around tight corners (e.g. small radii), which as previously stated, may lead to challenges in manufacturability.

Thus, an improved load bearing CMC component, such as a turbine nozzle band, and method of fabricating such load bearing CMC component is desired. The resulting load bearing CMC component, and more particularly, the included load path supports and retainment features, provide ease of manufacture, while maintaining strength and toughness of the overall CMC structure.

BRIEF DESCRIPTION

Various embodiments of the disclosure include a load bearing ceramic composite material (CMC) structure and method of fabrication. In accordance with one exemplary embodiment, disclosed is CMC component for a gas turbine. The CMC component includes a subcomponent, a load bearing wall and a wall support. Each of the subcomponent, load bearing wall and wall support comprised of a ceramic matrix composite (CMC) including reinforcing fibers embedded in a matrix. The CMC component further includes at least one joint joining the subcomponent, the load bearing wall and the wall support. The reinforcing fibers of the load bearing wall are oriented substantially normal to the reinforcing fibers of the subcomponent and the wall support.

In accordance with another exemplary embodiment, disclosed is a portion of a nozzle for a gas turbine. The portion of the nozzle includes a band flowpath, a load bearing wall and a wall support. Each of the band flowpath, the load bearing wall and the wall support comprised of a ceramic matrix composite (CMC) including reinforcing fibers embedded in a matrix. The band flowpath has an opening defined therein. At least one joint joins the band flowpath, the load bearing wall and the wall support to form a portion of a CMC component. The reinforcing fibers of the load bearing wall are oriented substantially normal to the reinforcing fibers of the band flowpath and the wall support.

In accordance with yet another exemplary embodiment, disclosed is a method of forming a ceramic matrix composite (CMC) component. The method including providing a subcomponent comprised of a ceramic matrix composite (CMC) including reinforcing fibers embedded in a matrix, providing a load bearing wall comprised of a ceramic matrix composite (CMC) including reinforcing fibers embedded in a matrix and providing a wall support comprised of a ceramic matrix composite (CMC) including reinforcing fibers embedded in a matrix. The method further including mechanically joining the subcomponent, the load bearing wall and the wall support to form a portion of a CMC component and to form at least one mechanical joint. The reinforcing fibers of the load bearing wall are oriented substantially normal to the reinforcing fibers of the subcomponent and the wall support.

Other objects and advantages of the present disclosure will become apparent upon reading the following detailed description and the appended claims with reference to the accompanying drawings. These and other features and improvements of the present application will become apparent to one of ordinary skill in the art upon review of the following detailed description when taken in conjunction with the several drawings and the appended claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
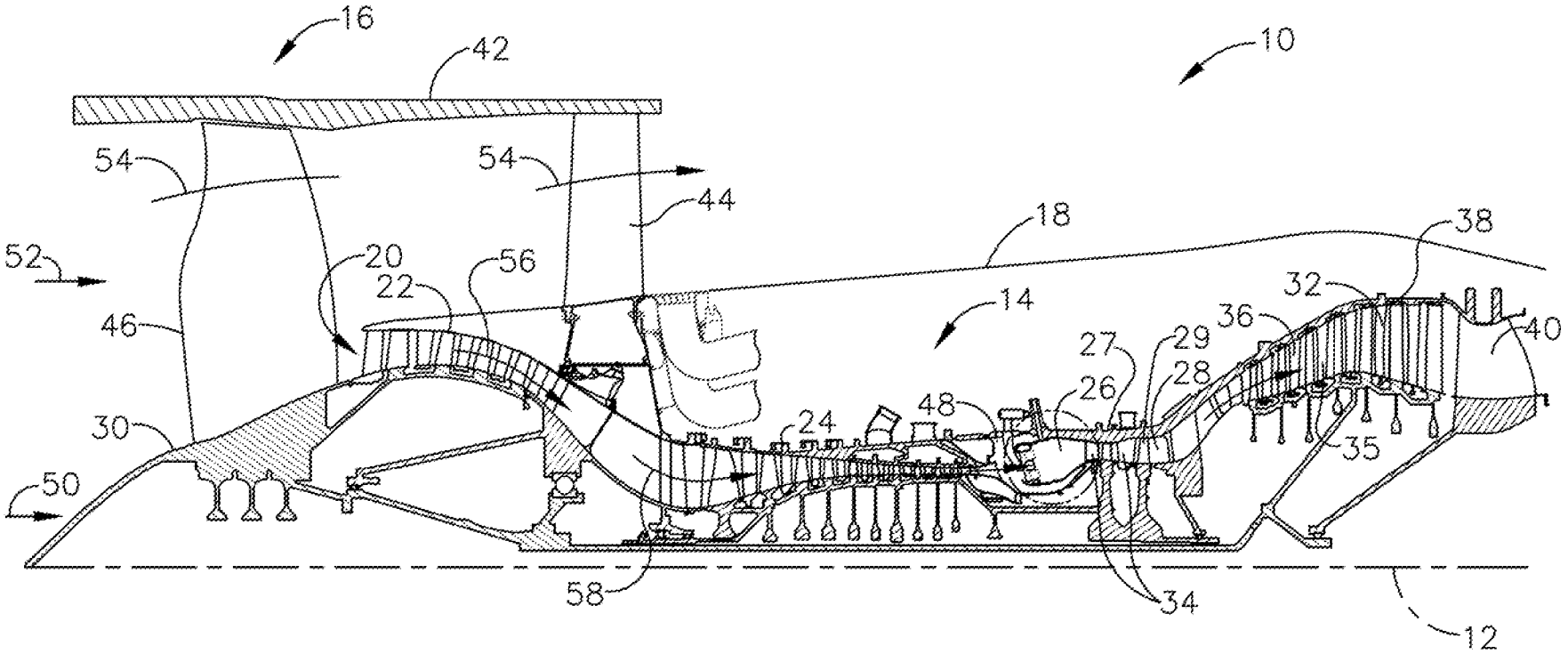
FIG. 1 is a cross sectional illustration of an aviation gas turbine engine, in accordance with one or more embodiments shown or described herein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

It is noted that the drawings as presented herein are not necessarily to scale. The drawings are intended to depict only typical aspects of the disclosed embodiments, and therefore should not be considered as limiting the scope of the disclosure. In the drawings, like numbering represents like elements between the drawings.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Approximating language, as used herein throughout the specification and claims, is applied to modify any quantitative representation that could permissibly vary without resulting in a change in the basic function to which it is related. Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by such term is not to be limited to the precise value specified. In at least some instances, the approximating language may correspond to the precision of an instrument for measuring the value. Here and throughout the specification and claims, range limitations are combined and interchanged. Such ranges are identified and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

As used herein, ceramic matrix composite or "CMCs" refers to composites comprising a ceramic matrix reinforced by ceramic fibers. Some examples of CMCs acceptable for use herein can include, but are not limited to, materials having a matrix and reinforcing fibers comprising oxides, carbides, nitrides, oxycarbides, oxynitrides and mixtures thereof. Examples of non-oxide materials include, but are not limited to, CMCs with a silicon carbide matrix and silicon carbide fiber (when made by silicon melt infiltration, this matrix will contain residual free silicon); silicon carbide/silicon matrix mixture and silicon carbide fiber; silicon nitride matrix and silicon carbide fiber; and silicon carbide/silicon nitride matrix mixture and silicon carbide fiber. Furthermore, CMCs can have a matrix and reinforcing fibers comprised of oxide ceramics. Specifically, the oxide-oxide CMCs may be comprised of a matrix and reinforcing fibers comprising oxide-based materials such as aluminum oxide ($Al_2O_3$),(silicon dioxide ($SiO_2$), aluminosilicates, and mixtures thereof. Accordingly, as used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC). In one embodiment, the ceramic matrix composite material has increased elongation, fracture toughness, thermal shock, and anisotropic properties as compared to a (non-reinforced) monolithic ceramic structure.

There are several methods that can be used to fabricate SiC—SiC CMCs. In one approach, the matrix is partially formed or densified through melt infiltration (MI) of molten silicon or silicon containing alloy into a CMC preform. In another approach, the matrix is at least partially formed through chemical vapor infiltration (CVI) of silicon carbide into a CMC preform. In a third approach, the matrix is at least partially formed by pyrolizing a silicon carbide yielding pre-ceramic polymer. This method is often referred to as polymer infiltration and pyrolysis (PIP). Combinations of the above three techniques can also be used.

In one example of the MI CMC process, a boron-nitride based coating system is deposited on SiC fiber. The coated fiber is then impregnated with matrix precursor material in order to form prepreg tapes. One method of fabricating the tapes is filament winding. The fiber is drawn through a bath of matrix precursor slurry and the impregnated fiber wound on a drum. The matrix precursor may contain silicon carbide and or carbon particulates as well as organic materials. The impregnated fiber is then cut along the axis of the drum and is removed from the drum to yield a flat prepreg tape where the fibers are nominally running in the same direction. The resulting material is a unidirectional prepreg tape. The prepreg tapes can also be made using continuous prepregging machines or by other means. The tape can then be cut into shapes, layed up, and laminated to produce a preform. The preform is pyrolyzed, or burned out, in order to char any organic material from the matrix precursor and to create porosity. Molten silicon is then infiltrated into the porous preform, where it can react with carbon to form silicon carbide. Ideally, excess free silicon fills any remaining porosity and a dense composite is obtained. The matrix produced in this manner typically contains residual free silicon.

The prepreg MI process generates a material with a two-dimensional fiber architecture by stacking together multiple one-dimensional prepreg plies where the orientation of the fibers is varied between plies. Plies are often identified based on the orientation of the continuous fibers. A zero degree orientation is established, and other plies are designed based on the angle of their fibers with respect to the zero degree direction. Plies in which the fibers run perpendicular to the zero direction are known as 90 degree plies, cross plies, or transverse plies.

The MI approach can also be used with two-dimensional or three-dimensional woven architectures. An example of this approach would be the slurry-cast process, where the fiber is first woven into a three-dimensional preform or into a two-dimensional cloth. In the case of the cloth, layers of cloth are cut to shape and stacked up to create a preform. A chemical vapor infiltration (CVI) technique is used to deposit the interfacial coatings (typically boron nitride based or carbon based) onto the fibers. CVI can also be used to deposit a layer of silicon carbide matrix. The remaining portion of the matrix is formed by casting a matrix precursor slurry into the preform, and then infiltrating with molten silicon.

An alternative to the MI approach is to use the CVI technique to densify the Silicon Carbide matrix in one-dimensional, two-dimensional or three-dimensional architectures. Similarly, PIP can be used to densify the matrix of the composite. CVI and PIP generated matrices can be produced without excess free silicon. Combinations of MI, CVI, and PIP can also be used to densify the matrix.

The interlocking mechanical joints described herein can be used conjunction with any load bearing CMC structural designs, such as those described in U.S. Publication No.

2017/0022833, by Heitman, B. et al. (hereinafter referred to as Heitman), filed on Jul. 24, 2015, and titled, "METHOD AND SYSTEM FOR INTERFACING A CERAMIC MATRIX COMPOSITE COMPONENT TO A METALLIC COMPONENT", which is incorporated herein in its entirety. More specifically, wherein the overall composite shape and geometry are described in the disclosure of Heitman, this disclosure includes various methods of including a wear interface laminate, which is normal to the load direction, to the geometrics of Heitman.

In particular, the interlocking mechanical joints described herein can be used to join various CMC materials, such as, but not limited to, Oxide-Oxide CMCs or SiC—SiC CMCs, or to join CMCs to monolithic materials. The interlocking mechanical joints can join subcomponents that are all MI based, that are all CVI based, that are all PIP based, or that are combinations thereof. In the case of interlocking mechanical joints, there may not be direct bonding of the subcomponents together, or the subcomponents may be bonded by silicon, silicon carbide, a combination thereof, or other suitable material. The bonding material may be deposited as a matrix precursor material that is subsequently densified by MI, CVI, or PIP. Alternatively, the bonding material maybe produced by MI, CVI, or PIP without the use of matrix precursor in the interlocking mechanical joint. Furthermore, the interlocking mechanical joints described herein may be formed at any appropriate stage in CMC processing. That is, the subcomponents may be comprised of green prepreg, laminated preforms, pyrolyzed preforms, fully densified preforms, or combinations thereof.

Referring now to the drawings wherein like numerals correspond to like elements throughout, attention is directed initially to FIG. 1 which depicts in diagrammatic form an exemplary gas turbine engine 10 utilized with aircraft having a longitudinal or axial centerline axis 12 therethrough for reference purposes. It should be understood that the principles described herein are equally applicable to turbofan, turbojet and turboshaft engines, as well as turbine engines used for other vehicles or in stationary applications. In an effort to provide a concise description of these embodiments, not all features of an actual implementation are described in the specification. Furthermore, while a turbine nozzle is used as an example, the principles of the present invention are applicable to any low-ductility flowpath component which is at least partially exposed to a primary combustion gas flowpath of a gas turbine engine and formed of a ceramic matrix composite (CMC) material, and more particularly, any airfoil-platform-like structure, such as, but not limited to, blades, tip-shrouds, or the like.

Engine 10 preferably includes a core gas turbine engine generally identified by numeral 14 and a fan section 16 positioned upstream thereof. Core engine 14 typically includes a generally tubular outer casing 18 that defines an annular inlet 20. Outer casing 18 further encloses a booster compressor 22 for raising the pressure of the air that enters core engine 14 to a first pressure level. A high pressure, multi-stage, axial-flow compressor 24 receives pressurized air from booster 22 and further increases the pressure of the air. The pressurized air flows to a combustor 26, where fuel is injected into the pressurized air stream to raise the temperature and energy level of the pressurized air. The high energy combustion products flow from combustor 26 to a first high pressure (HP) turbine 28 for driving high pressure compressor 24 through a first HP drive shaft, and then to a second low pressure (LP) turbine 32 for driving booster compressor 22 and fan section 16 through a second LP drive shaft that is coaxial with first drive shaft. The HP turbine 28 includes a HP stationary nozzle 34. The LP turbine 32 includes a stationary LP nozzle 35. A rotor disk is located downstream of the nozzles that rotates about the centerline axis 12 of the engine 10 and carries an array of airfoil-shaped turbine blades 36. Shrouds 29, 38, comprising a plurality of arcuate shroud segments, are arranged so as to encircle and closely surround the turbine blades 27, 36 and thereby define the outer radial flowpath boundary for the hot gas stream flowing through the turbine blades 27, 36. After driving each of the turbines 28 and 32, the combustion products leave core engine 14 through an exhaust nozzle 40.

Fan section 16 includes a rotatable, axial-flow fan rotor 30 and a plurality of fan rotor blades 46 that are surrounded by an annular fan casing 42. It will be appreciated that fan casing 42 is supported from core engine 14 by a plurality of substantially radially-extending, circumferentially-spaced outlet guide vanes 44. In this way, fan casing 42 encloses fan rotor 30 and the plurality of fan rotor blades 46.

From a flow standpoint, it will be appreciated that an initial air flow, represented by arrow 50, enters gas turbine engine 10 through an inlet 52. Air flow 50 passes through fan blades 46 and splits into a first compressed air flow (represented by arrow 54) that moves through the fan casing 42 and a second compressed air flow (represented by arrow 56) which enters booster compressor 22. The pressure of second compressed air flow 56 is increased and enters high pressure compressor 24, as represented by arrow 58. After mixing with fuel and being combusted in combustor 26, combustion products 48 exit combustor 26 and flow through first turbine 28. Combustion products 48 then flow through second turbine 32 and exit exhaust nozzle 40 to provide thrust for gas turbine engine 10.

Many of the engine components may be fabricated in several pieces, due to complex geometries, and are subsequently joined together. These components may also be directly subjected to hot combustion gases during operation of the engine 10 and thus have very demanding material requirements. Accordingly, many of the components of the engine 10 that are fabricated from ceramic matrix composites (CMCs) may be fabricated in more than one piece and subsequently joined together. As previously stated, of particular concern herein are load bearing CMC components, such as turbine nozzle bands, with a focus on load path supports and retainment features of the CMC components, such as mounting supports on turbine nozzle bands. In a preferred embodiment, a plurality of simple geometry subcomponents (e.g. flat sections) are utilized in forming the turbine nozzle bands, such as make up the HP turbine nozzle 34 (FIG. 1). The use of a plurality of subcomponents allows for the desired fiber orientations without the need for bending of the fibers, while reducing manufacturing complexity.

In joining multiple CMC pieces, or subcomponents, such as a plurality of turbine nozzle band subcomponents, including load path supports and retainment features, it is desirable to form joints during the component layup process that are damage tolerant and exhibit tough, graceful failure. If the interlocking mechanical joint that joins the multiple CMC subcomponents fails, it may result in a catastrophic failure of the component structure.

Of particular concern for these joints is that the bond line tends to be brittle in nature, which could lead to brittle failure of the interlocking mechanical joint. It has been established in the CMC art that this limitation can be addressed by keeping the stress in the bond low by controlling the surface area of the bond and by making use of simple woodworking type joints such as butt joints, lap joints, tongue and groove joints, mortise and tenon joints, as well as more elaborate sawtooth or stepped tapered joints. Alternatively, joints that contain a mechanical interlock of the CMC sub-components have also demonstrated graceful failure. Conventional woodworking joints such as dovetail joints have been demonstrated. The above joints can be used to join CMC sub-components in two or three dimensions such as flat plates and "T" shapes. While many woodworking type joints can create a mechanical interlock between two CMC subcomponents, in order for the interlock to take advantage of the full toughness of the CMC, the interlocking feature(s) must be oriented such that the reinforcing fibers would be required to break in order to fail the interlock. If the interlocking feature is oriented such that the interlocking mechanical joint can be liberated by failing one of the CMC subcomponents in the interlaminar direction, then toughness of the interlock may be limited by the interlaminar properties of the CMC. In general, the interlaminar strength and toughness of CMCs are significantly lower than the in-plane properties.

Figure 2:
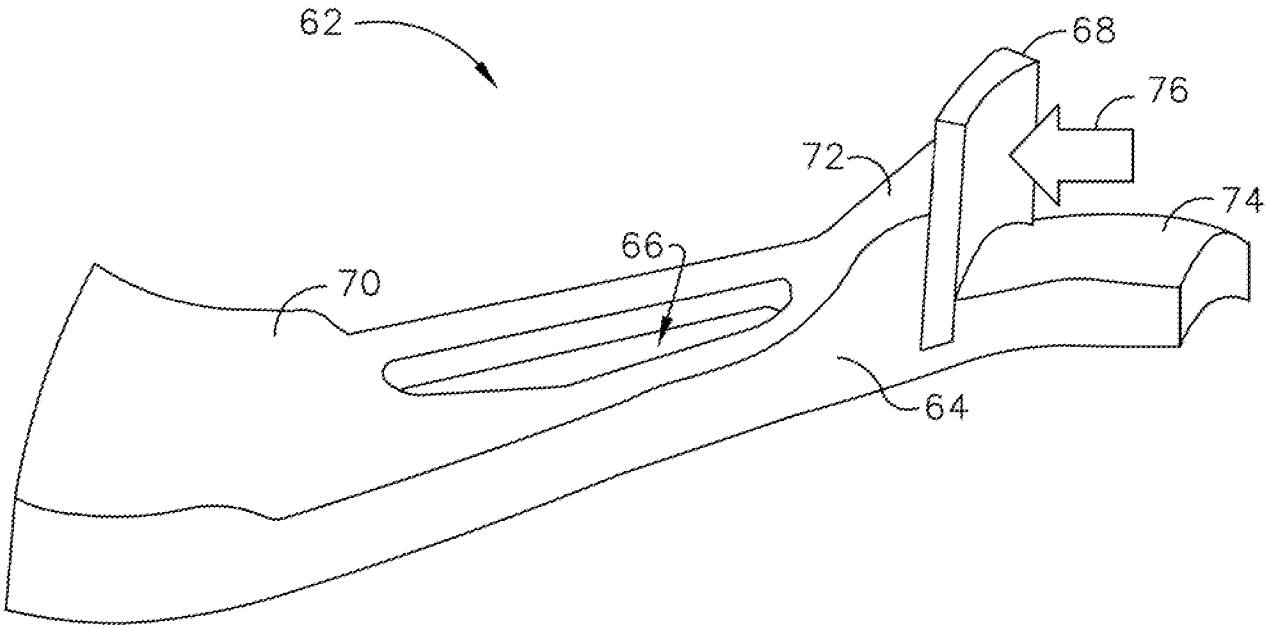
FIG. 2 is a schematic perspective view of a portion of load bearing component, and more specifically a portion of a gas turbine nozzle band, in accordance with one or more embodiments shown or described herein.

Referring now to FIG. 2, illustrated in a simplified perspective view is a portion of turbine nozzle 60, such as nozzle 34 of FIG. 1, and more particularly a portion of the load bearing component of the nozzle 34. The nozzle 34 is generally comprised of a plurality of vanes (not shown) and a plurality of bands 62, of which only a portion of a single band is shown in FIG. 2. In exemplary embodiments, each of the plurality of vanes extends between a plurality of bands 62 and engages with one or more of the bands 62.

It should be understood that while a nozzle generally comprised of a plurality of vanes and a plurality of bands is described throughout this disclosure, the description provided is applicable to any type of structure comprised of subcomponents such as, but not limited to, a combustor liner, a shroud, a turbine center frame, or the like. Accordingly, as described below, a first CMC subcomponent is not limited to a band flowpath.

Referring again to FIG. 2, each of the plurality of bands 62 is defined by a first CMC subcomponent 63, which in the illustrated embodiment, is a band flowpath 64 having an opening 66 formed therein. The opening 66 is configured to engage with a vane (not shown) and provide a cooling medium (not shown) to flow into a cavity of the vane that is coupled thereto, as is generally known in the art. Each of the plurality of bands 62 is further defined by a second CMC subcomponent, and more particularly, a load bearing wall 68. As best illustrated in FIG. 2, the load bearing wall 68 is positioned substantially perpendicular relative to the band flowpath 64.

In the illustrated embodiment, a surface 70 of the band flowpath 64 is contoured to define a wall support 72. In alternate embodiment, the band flowpath 64 may be configured substantially planar (described presently), yet still provide support for the load bearing wall 68. In yet another embodiment, the wall support 72 may be defined as a separate and distinct CMC component (described presently), not formed integral therewith the flowpath 64, yet configured to provide support to the load bearing wall 68.

As illustrated, the band flowpath 64 is configured to include an overhang 74 that may provide retainment (described presently) of the load bearing wall 68 and/or additional aid in providing additional support (described presently) to the load bearing wall 68. During operation, an applied bearing load (i.e. mechanical or aero) 76 is exerted on the load bearing wall 68 as indicated.

Referring now to FIGS. 3-20, illustrated are a plurality of embodiments of a portion of a CMC load bearing component, and more specifically, a portion of a nozzle band, comprising a plurality of CMC subcomponents, that provide for an interlocking mechanical joint for a bearing load (i.e. mechanical or aero) approximately normal to the fiber plane of the subcomponent.

It should be known that throughout the embodiments, only a portion of the nozzle, and more particularly, a portion of a single band are illustrated. As illustrated, each figure is depicted having a simplified block geometry and illustrated noting a linear direction of the plies within the component, as linear fill lines. However, the fibers in individual plies may be oriented in any direction within the plane defined by the fill line as projected in and out of the page. In each of the embodiments disclosed herein, the described interlocking mechanical joints may be used to join the band flowpath 64, the load bearing wall 68 and the wall support 72, whether an integral feature, or separate discrete subcomponent, to form a portion of larger or component structure, such as nozzle 34 of FIG. 1. In alternate embodiments, any of the band 62 subcomponents may be comprised as a monolithic ceramic subcomponent.

Figure 3:
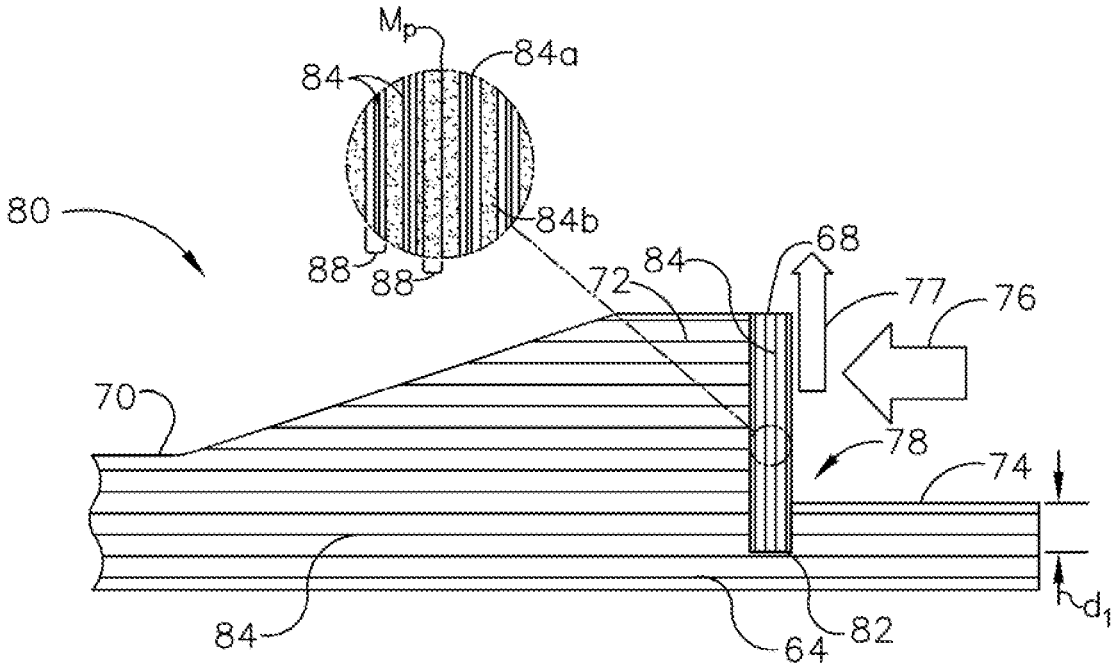
FIG. 3 is a schematic sectional view illustrating an embodiment of a portion of load bearing component, in accordance with one or more embodiments shown or described herein.

Referring more specifically to FIG. 3, illustrated is an embodiment of a portion of a band 80, comprising a plurality of CMC subcomponents joined at an interlocking mechanical joint 78, as described herein. More specifically, in this particular embodiment, the band 80 subcomponents comprise a band flowpath 64 and a load bearing wall 68. The load bearing 68 is disposed within a recess 82 formed in the band flowpath 64. In this configuration, the overhang 74 provides additional support to the load bearing wall 68 on the load side. As in the embodiment of FIG. 2, the surface 70 of the band flowpath 64 is contoured in a manner to define the wall support 72. In an embodiment, the load bearing wall 68 is disposed a depth $d_1$ into the band flowpath.

Each of the band flowpath 64, including the wall support 72 and the load bearing wall 68 are configured to cooperatively engage to form the interlocking mechanical joint 78. As used herein the term "engage" and "sliding engagement" include fixed or non-fixed insertion therein of the interlocking subcomponents, relative to one another.

In the embodiments of FIG. 3, the band flowpath 64 and the load bearing wall 68 are constructed from a ceramic matrix composite (CMC) material of a known type. In particular, the CMC material includes a plurality of reinforcing fibers embedded in a matrix and wherein the plurality of reinforcing fibers are oriented substantially along a length of the component. In an alternate embodiment, one of the band flowpath 64 or the load bearing wall 68 is formed of a ceramic matrix composite (CMC) material of a known type, while the other of the band flowpath 64 or the load bearing wall 68 is formed of a monolithic ceramic material. Throughout the embodiments, fill lines represent the orientation/planes of a plurality of fiber plies 88 that comprise CMC band subcomponents, and more particularly, the band flowpath 64, the load bearing wall 68 and any additional CMC subcomponents (presently described). Accordingly, the assembled portion of the nozzle 80 may include one or more CMC subcomponents and one or more monolithic ceramic subcomponents, or all subcomponents may be of a ceramic matrix composite (CMC) material.

Monolithic ceramics, such as SiC are typically brittle materials. The stress strain curve for such a material is generally a straight line that teminates when the sample fractures. The failure stress is often dictated by the presence of flaws and failure occurs by rapid crack growth from a critical flaw. The abrupt failure is sometimes referred to as brittle or catastrophic failure. While the strength and failure strain of the ceramic are flaw dependent, it is not uncommon for failure strains to be on the order of −0.1%.

Generally, CMC materials include a high strength ceramic type fiber, such as Hi-Nicalon™ Type S manufactured by COI Ceramics, Inc. The fiber is embedded in a ceramic type matrix, such as SiC or SiC that contains residual free silicon. In the example of a SiC—SiC composite, where SiC fiber reinforces a SiC matrix, an interface coating such as Boron Nitride is typically applied to the fiber. This coating allows the fiber to debond from the matrix and slide in the vicinity of a matrix crack. A stress-strain curve for the fast fracture of a SiC—SiC composite generally has an initial linear elastic portion where the stress and strain are proportional to each other. As the load is increased, eventually the matrix will crack. In a well-made composite, the crack will be bridged by the reinforcing fiber. As the load on the composite is further increased, additional matrix cracks will form, and these cracks will also be bridged by the fibers. As the matrix cracks, it sheds load to the fibers and the stress strain curve becomes non-linear. The onset of non-linear stress-strain behavior is commonly referred to as the proportional limit or the matrix cracking stress. The bridging fibers impart toughness to the composite as they debond from the matrix and slide in the vicinity of the matrix cracks. At the location of a through crack, the fibers carry the entire load that is applied to the composite. Eventually, the load is great enough that the fibers fail, which leads to composite failure. The ability of the CMC to carry load after matrix cracking is often referred to as graceful failure. The damage tolerance exhibited by CMCs makes them desirable over monolithic ceramics that fail catastrophically.

CMC materials are orthotropic to at least some degree, i.e. the material's tensile strength in the direction parallel to the length of the fibers (the fiber direction, or 0 degree direction) is stronger than the tensile strength in the perpendicular directions (the 90 degree or the interlaminar/through thickness direction). Physical properties such as modulus and Poisson's ratio also differ with respect to fiber orientation. Most composites have fibers oriented in multiple directions. For example, in the prepreg MI SiC—SiSiC CMC, the architecture is comprised of layers, or plies, of unidirectional fibers. A common architecture consists of alternating layers of 0 and 90 degree fibers, which imparts toughness in all directions in the plane of the fibers. This ply level architecture does not, however, have fibers that run in the through thickness or interlaminar direction. Consequently, the strength and toughness of this composite is lower in the interlaminar direction than in the in-plane directions.

CMCs exhibit tough behavior and graceful failure when matrix cracks are bridged by fibers. Of greatest concern herein is failure of the interlocking mechanical joint that is formed when the CMC material subcomponents forming the band portion of the nozzle 34 are joined together, in response to an applied load. If the interlocking mechanical joint is loaded in a direction such that it can fail and separate without breaking fibers, then there is the potential for brittle, catastrophic failure of that joint. Alternatively, if the interlocking mechanical joint is loaded in a direction such that, after matrix cracking in the interlocking mechanical joint, fibers bridge the crack, then there is the potential for tough, damage tolerant, graceful failure of the interlocking mechanical joint.

As illustrated in the blown-out enlargement of FIG. 3, in the embodiments disclosed herein (FIGS. 3-20), each of the subcomponents that form the overall structure of the bands, including the band flowpath 64, the load bearing wall 68, and any additional CMC subcomponents (presently described) are comprised of a plurality of fibers 84 forming the plies 88 oriented in the plane of the respective subcomponent so as to provide improved interlocking of the interlocking mechanical joint 78 and minimize joint failure. It is desirable to orient fibers 84 normal to the load direction in order to optimize the wear interface to the load path. The CMC interlaminar properties are lower than the CMC in-plane properties, and edge loading the laminate of the wall support 72 in the absence of the wall 68 could also lead to interlaminar damage or interlaminar failure. The fibers 84 oriented approximately normal to the load direction, will help to distribute the load on the underlying ply edges of the wall support 72, thereby reducing the likelihood of interlaminar damage/failure. In the event of interlaminar damage in the wall support 72, the fibers 84 could help prevent interlaminar failure. In the embodiment of FIG. 3, as illustrated the plurality of fibers 84 extend from top to bottom in a layer 84*a* and into and out of the paper in a layer 84*b*. In the illustrated embodiment, the architecture of the plies 88 is symmetric about a mid-plane ($M_p$) of the component. Maintaining symmetry of the component plies 88 helps to minimize any distortion or stresses that may arise due to any differences between 0-degree and 90-degree plies. The illustrated 8-ply panel is illustrated having a typical architecture (0/90/0/90:90/0/90/0), which is symmetric about the mid-plane $M_p$. In an alternate embodiment, the plies 88 are not symmetric about the mid-plane $M_p$. In yet another alternate embodiment, the architecture includes plies 88 oriented in a direction other than 0 or 90 degrees, such as +/− 45 degrees (load bearing wall 68 of FIG. 18), some other angle, or a combination of various angles. In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64 and the load bearing wall 68 are not connected by fibers 84 as none of the fibers 84 bridge the interlocking mechanical joint 78. The fibers 84 in the wall support 68 are oriented normal to the fibers 84 in the flow platform 64 and thus would need to break in order for the wall support 68 to fail under loading 76. In this manner, the interlocking mechanical joint 78 has toughness in the loading direction.

Figure 4:
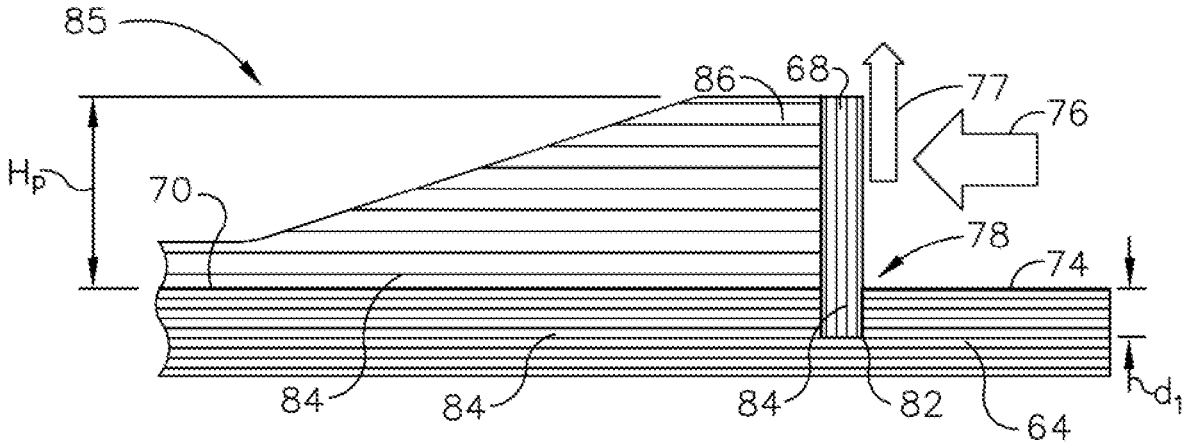
FIG. 4 is a schematic sectional view illustrating another embodiment of a portion of load bearing component, in accordance with one or more embodiments shown or described herein.
Figure 5:
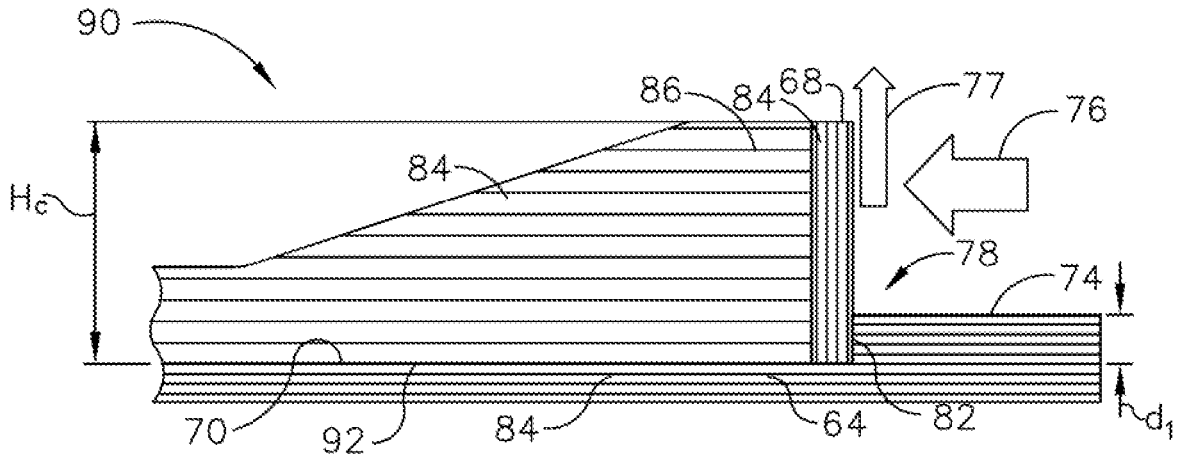
FIG. 5 is a schematic sectional view illustrating another embodiment of a portion of load bearing component, in accordance with one or more embodiments shown or described herein.

Referring now to FIGS. 4 and 5, illustrated in simplified sectional views are alternate embodiment of a band 85, 90, respectively, comprised of a plurality of subcomponents and the joining of the subcomponents to form a portion of a larger component structure, and more particularly a nozzle, such as nozzle 34 of FIG. 1. It should be noted that in the embodiments illustrating and describing the bands 85, 90 that only a portion of each of the bands 85, 90 is illustrated. In the embodiment of FIGS. 4 and 5, illustrated is a load bearing wall 68 being joined thereto the band flowpath 64 at an interlocking mechanical joint 78. In contrast to the embodiment of FIG. 3, in the embodiment of FIG. 4, a separate and discrete wall support 86 is disposed on a surface 70 of the band flowpath 64 to provide support to the load bearing wall 68 along a portion of the height "$H_p$" of the load bearing wall 68. Similar to the embodiment of FIG. 3, the load bearing wall 68 is disposed within a recess 82 formed in the band flowpath 64. In an embodiment, the load bearing wall 68 is disposed a depth $d_1$ into the band flowpath 64. In this configuration, the overhang 74 provides additional support to the load bearing wall 68 on the load side. In contrast to the embodiment of FIGS. 3 and 4, in the embodiment of FIG. 5, a separate and discrete wall support 86 is disposed in a recess 92 formed into the surface 70 of the band flowpath 64 to provide support to the load bearing wall 68 along a complete height "$H_c$" of the load bearing wall 68. In an alternate embodiment, the discrete wall support 86 provides support to the load bearing wall 68 along only a partial height of the load bearing wall 68. In this configuration, the overhang 74 provides additional support to the load bearing wall 68 on the load side.

In the illustrated embodiments of FIGS. 4 and 5, the band flowpath 64, the load bearing wall 68 and the discrete wall support 86 are formed of a ceramic matrix composite (CMC) including reinforcing fibers 84 embedded in a matrix. In an alternate embodiment, at least one of the band flowpath 64, the load bearing wall 68 or the discrete wall support 86 are formed as a ceramic monolithic subcomponent. As illustrated in FIGS. 4 and 5, the band flowpath 64, the load bearing wall 68 and the discrete wall support 86 are illustrated joined one to the other at the interlocking mechanical joint 78.

In response to the expected loading direction, as illustrated by arrow 76, failure of the interlocking mechanical joint 78 in FIGS. 4 and 5 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68 and the discrete wall support 86 are not connected by fibers 84 as none of the fibers 84 bridge the interlocking mechanical joint 78. The fibers 84 in the load bearing wall 68 are oriented substantially normal to the fibers 84 in the band flowpath 64 and the discrete wall support 86 and thus would need to break in order for the load bearing wall 68 to fail under loading 76. In this manner, the interlocking mechanical joint 78 has toughness in the loading direction.

Figure 6:
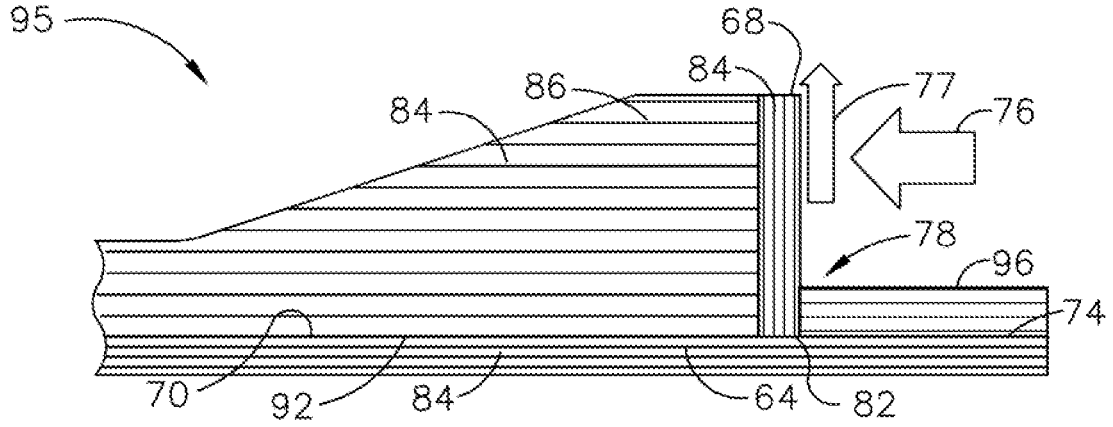
FIG. 6 is a schematic sectional view illustrating another embodiment of a portion of load bearing component, in accordance with one or more embodiments shown or described herein.

Referring now to FIG. 6, illustrated in simplified sectional view is an another embodiment of band 95 comprised of a plurality of subcomponents and the joining of the subcomponents to form a portion of a larger component structure, and more particularly a nozzle, such as nozzle 34 of FIG. 1. It should be noted that in the embodiment illustrating and describing the band 95 that only a portion of the band 95 is illustrated. In the embodiment of FIG. 6, illustrated is a load bearing wall 68 being joined thereto the band flowpath 64 at an interlocking mechanical joint 78. In contrast to the previous embodiments, in this particular embodiment, the band flowpath 64 does not provide any direct lateral support to the load bearing wall 68. In this embodiment, a separate and discrete wall support 86 is disposed on a surface 70 of the band flowpath 64 to provide support to the load bearing wall 68. In addition, in this particular embodiment, a secondary wall support 96 is positioned on an uppermost surface 75 of the overhang 74. The secondary wall support 96 provides additional support to the load bearing wall 68 on the load side. In the illustrated embodiment of FIG. 6, the band flowpath 64, the load bearing wall 68, the discrete wall support 86 and the secondary wall support 96 are formed of a ceramic matrix composite (CMC) including reinforcing fibers 84 embedded in a matrix. In an alternate embodiment, at least one of the band flowpath 64, the load bearing wall, the discrete wall support 86 and the secondary wall support 96 are formed as a ceramic monolithic subcomponent. As illustrated in FIG. 6, the band flowpath 64, the load bearing wall, the discrete wall support 86 and the secondary wall support 96 are illustrated joined one to the other at the interlocking mechanical joint 78.

In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68, the discrete wall support 86 and the secondary wall support 96 are not connected by fibers 84 as none of the fibers 84 bridge the interlocking mechanical joint 78. The fibers 84 in the load bearing wall 68 are oriented substantially normal to the fibers 84 in the band flowpath 64, the discrete wall support 86 and the secondary wall support 96 and thus would need to break in order for the load bearing wall 68 to fail under loading 76. In this manner, the interlocking mechanical joint has toughness in the loading direction.

Figure 7:
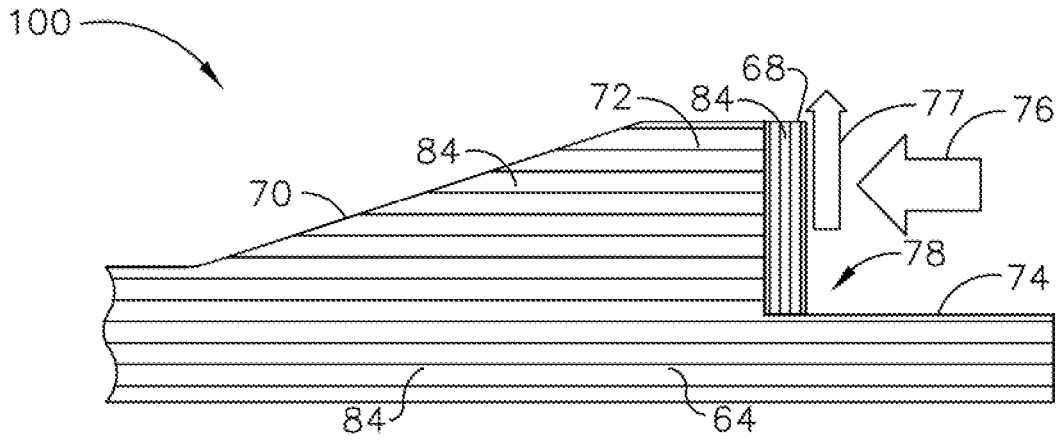
FIG. 7 is a schematic sectional view illustrating another embodiment of a portion of load bearing component, in accordance with one or more embodiments shown or described herein.
Figure 8:
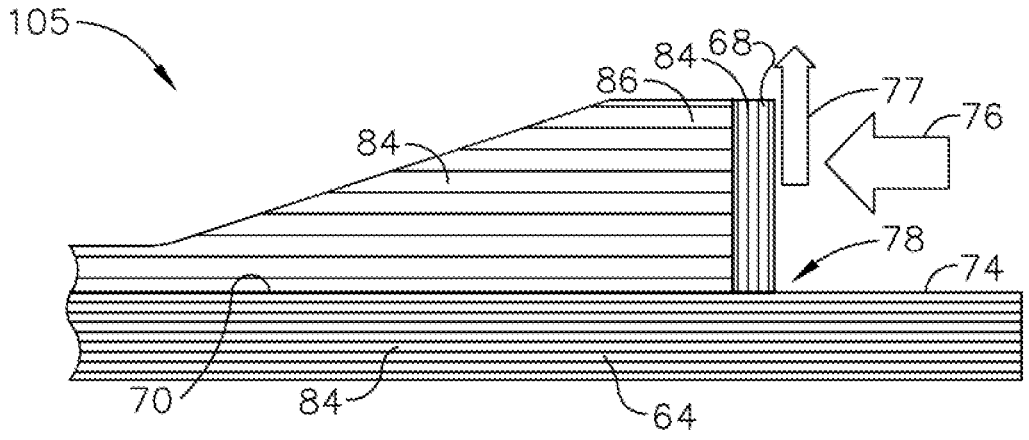
FIG. 8 is a schematic sectional view illustrating another embodiment of a portion of load bearing component, in accordance with one or more embodiments shown or described herein.

Referring now to FIGS. 7 and 8, illustrated in simplified sectional views are additional embodiments of a band, referenced 100, 105, respectively, comprised of a plurality of subcomponents and the joining of the subcomponents to form a portion of a larger component structure, and more particularly a nozzle, such as nozzle 34 of FIG. 1. Similar to the previous embodiment, it should be noted that in the embodiments illustrating and describing the bands 100, 105 that only a portion of the respective band is illustrated. The embodiment of FIG. 7 is generally similar to the previously described embodiment of FIG. 3 wherein the band flowpath 64 is contoured to define an integral wall support 72. The embodiment of FIG. 8 is generally similar to the embodiment of FIG. 4 wherein a separate and discrete wall support 86 is disposed on a surface 70 of the band flowpath 64 to provide support to the load bearing wall 68. In the embodiment of FIGS. 7 and 8, illustrated is a load bearing wall 68 being joined thereto the band flowpath 64 at an interlocking mechanical joint 78, and a respective wall support 72 or 86. In contrast to the embodiments of FIGS. 3 and 4, the load bearing wall 68 of the embodiments of FIGS. 7 and 8 is not recessed into the surface 70 of the band flowpath 64. Accordingly, the band flowpath 64, and more particularly the integrally formed wall support 72, in FIG. 7 provides direct lateral support to the load bearing wall 68, but the band flowpath 64 in FIG. 8 does not provide any direct lateral support to the load bearing wall 68. In the illustrated embodiments of FIGS. 7 and 8, the band flowpath 64, the load bearing wall 68 and the wall support 72 or 86 are formed of a ceramic matrix composite (CMC) including reinforcing fibers 84 embedded in a matrix. In an alternate embodiment, at least one of the band flowpath 64, the load bearing wall 68 and the wall support 72 or 86 are formed as a ceramic monolithic subcomponent. As illustrated in FIGS. 7 and 8, the band flowpath 64, the load bearing wall 68 and the wall support 72 or 86 are illustrated joined one to the other at the interlocking mechanical joint 78.

In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68 and the wall support 72 or 86 are not connected by fibers 84 as none of the fibers 84 bridge the interlocking mechanical joint 78. The fibers 84 in the load bearing wall 68 are oriented substantially normal to the fibers 84 in the band flowpath 64 and the wall support 72 or 86 and thus would need to break in order for the load bearing wall 68 to fail under loading 76. In this manner, the interlocking mechanical joint 78*m* has toughness in the loading direction.

Figure 9:
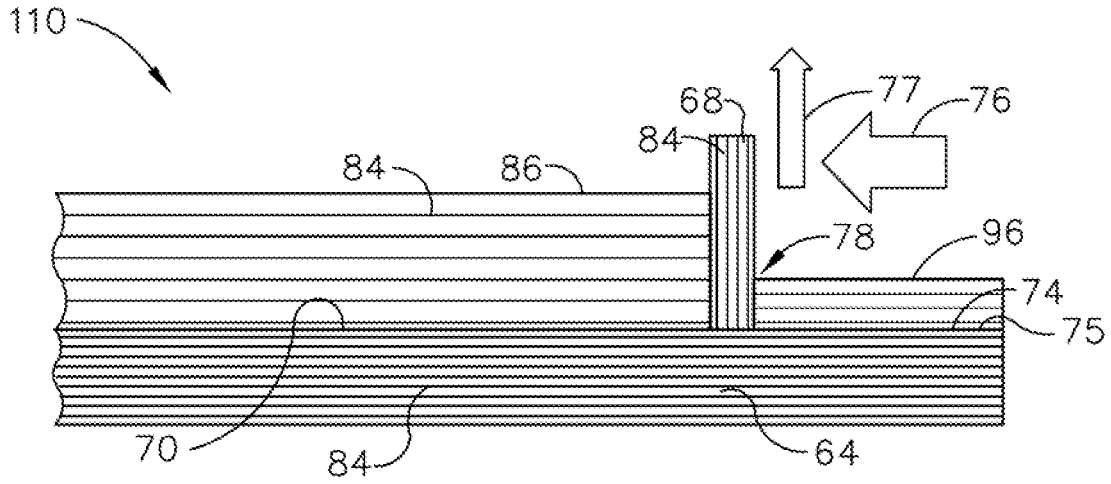
FIG. 9 is a schematic sectional view illustrating another embodiment of a portion of load bearing component, in accordance with one or more embodiments shown or described herein.

Referring now to FIG. 9, illustrated in simplified sectional view is an another embodiment of band 110 comprised of a plurality of subcomponents and the joining of the subcomponents to form a portion of a larger component structure, and more particularly a nozzle, such as nozzle 34 of FIG. 1. It should be noted that in the embodiment illustrating and describing the band 110 that only a portion of the band 110 is illustrated. In the embodiment of FIG. 9, illustrated is a load bearing wall 68 being joined thereto the band flowpath 64 at an interlocking mechanical joint 78. Similar to the embodiments of FIGS. 6 and 8, in this particular embodiment, the band flowpath 64 does not provide any direct lateral support to the load bearing wall 68. In this embodiment, a separate and discrete wall support 86 is disposed on a surface 70 of the band flowpath 64 to provide support to the load bearing wall 68. In contrast to the previously disclosed embodiments, in this particular embodiment, the discrete wall support 86 is substantially planar, including only minimal contouring, if at all. In addition, in this particular embodiment, a secondary wall support 96 is positioned on an uppermost surface 75 of the overhang 74. The secondary wall support 96 provides additional support to the load bearing wall 68 on the load side. In the illustrated embodiment of FIG. 9, the band flowpath 64, the load hearing wall 68, the discrete wall support 86 and the secondary wall support 96 are formed of a ceramic matrix composite (CMC) including reinforcing fibers 84 embedded in a matrix. In an alternate embodiment, at least one of the band flowpath 64, the load bearing wall, the discrete wall support 86 and the secondary wall support 96 are formed as a ceramic monolithic subcomponent. As illustrated in FIG. 9, the band flowpath 64, the load bearing wall 68, the discrete wall support 86 and the secondary wall support 96 are illustrated joined one to the other at the interlocking mechanical joint 78.

In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68, the wall support 72 and the secondary wall support 96 are not connected by fibers as none of the fibers bridge the interlocking mechanical joint 78. The fibers 84 in the load bearing wall 68 are oriented substantially normal to the fibers 84 in the band flowpath 64, the discrete wall support 86 and the secondary wall support 96 and thus would need to break in order for the load bearing wall 68 to fail under loading 76. In this manner, the interlocking mechanical joint 78 has toughness in the loading direction.

Figure 10:
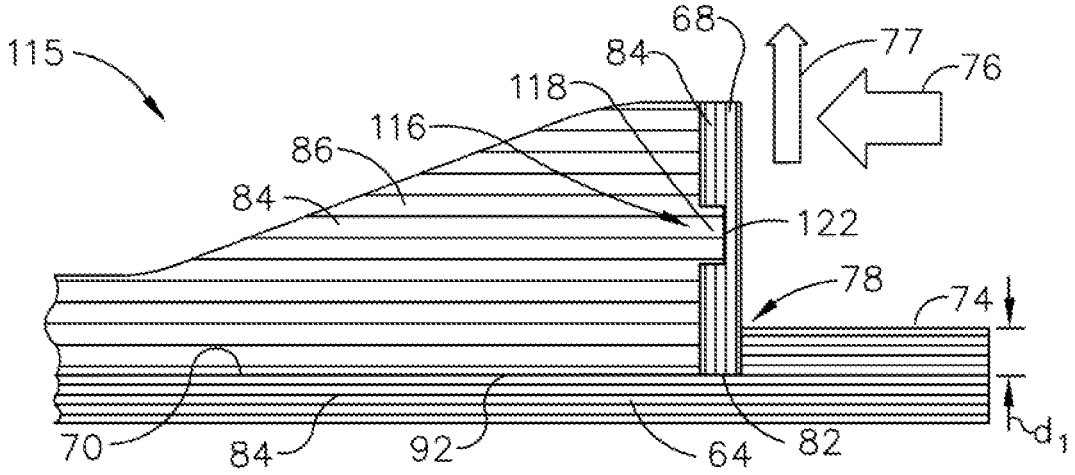
FIG. 10 is a schematic sectional view illustrating another embodiment of a portion of load bearing component, in accordance with one or more embodiments shown or described herein.
Figure 11:
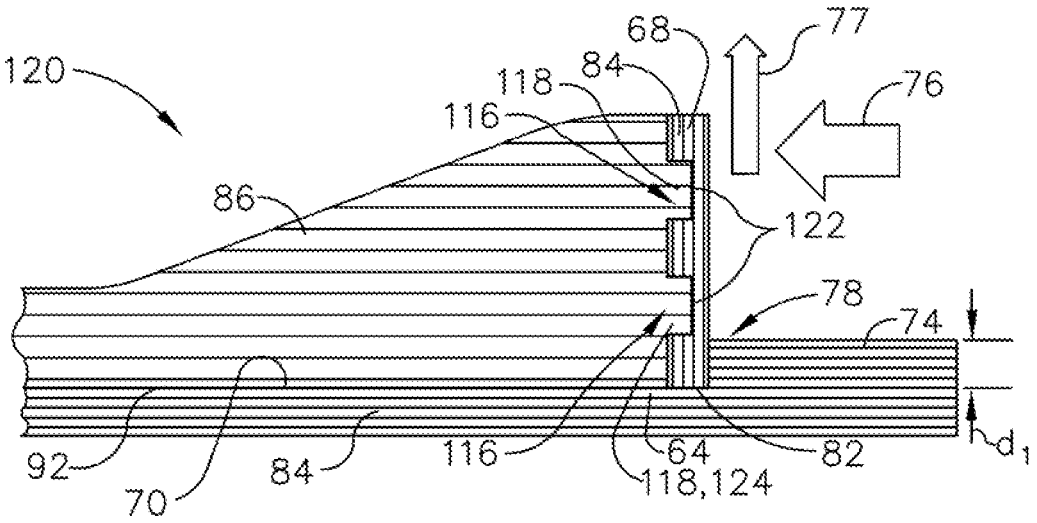
FIG. 11 is a schematic sectional view illustrating another embodiment of a portion of load bearing component, in accordance with one or more embodiments shown or described herein.
Figure 12:
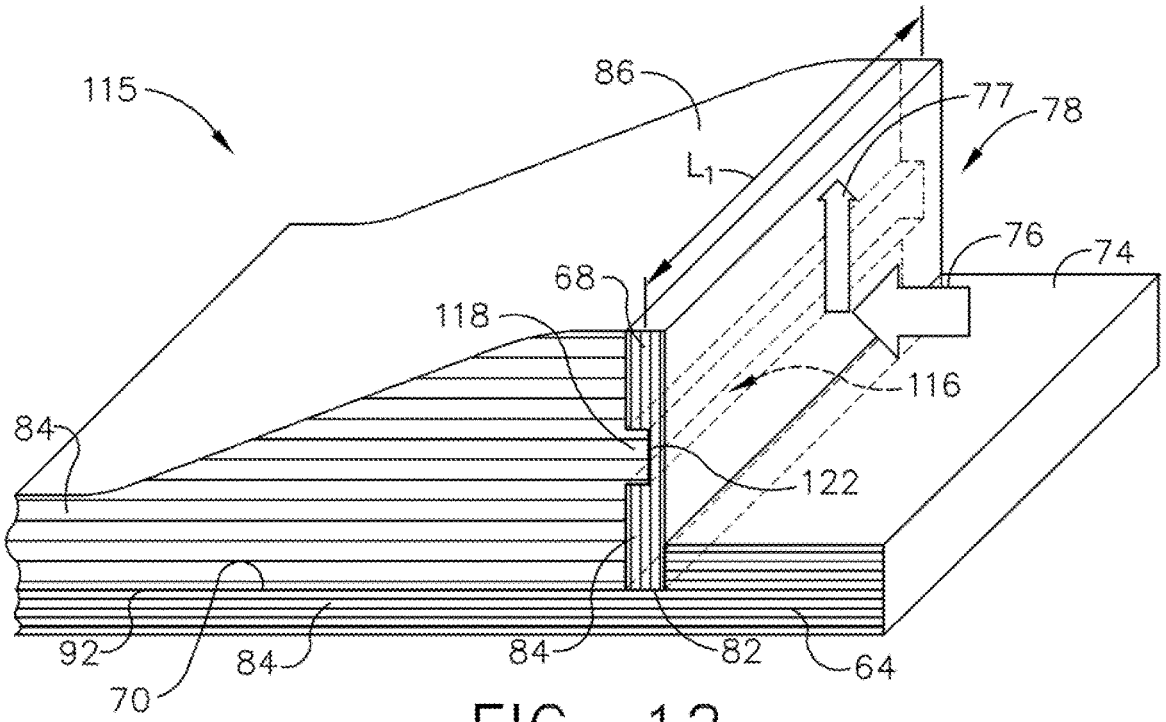
FIG. 12 is a schematic isometric view of the embodiment of FIG. 10, in accordance with one or more embodiments shown or described herein.
Figure 13:
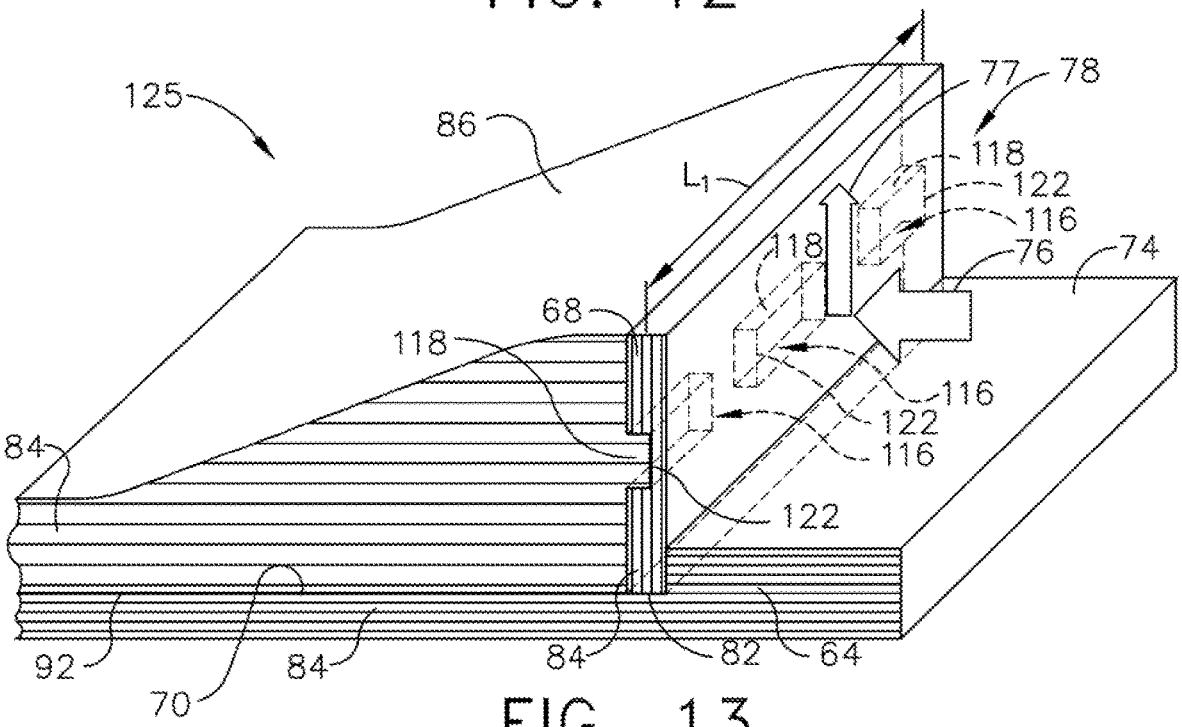
FIG. 13 is a schematic isometric view of another embodiment of the tabbed load bearing wall, in accordance with one or more embodiments shown or described herein.
Figure 14:
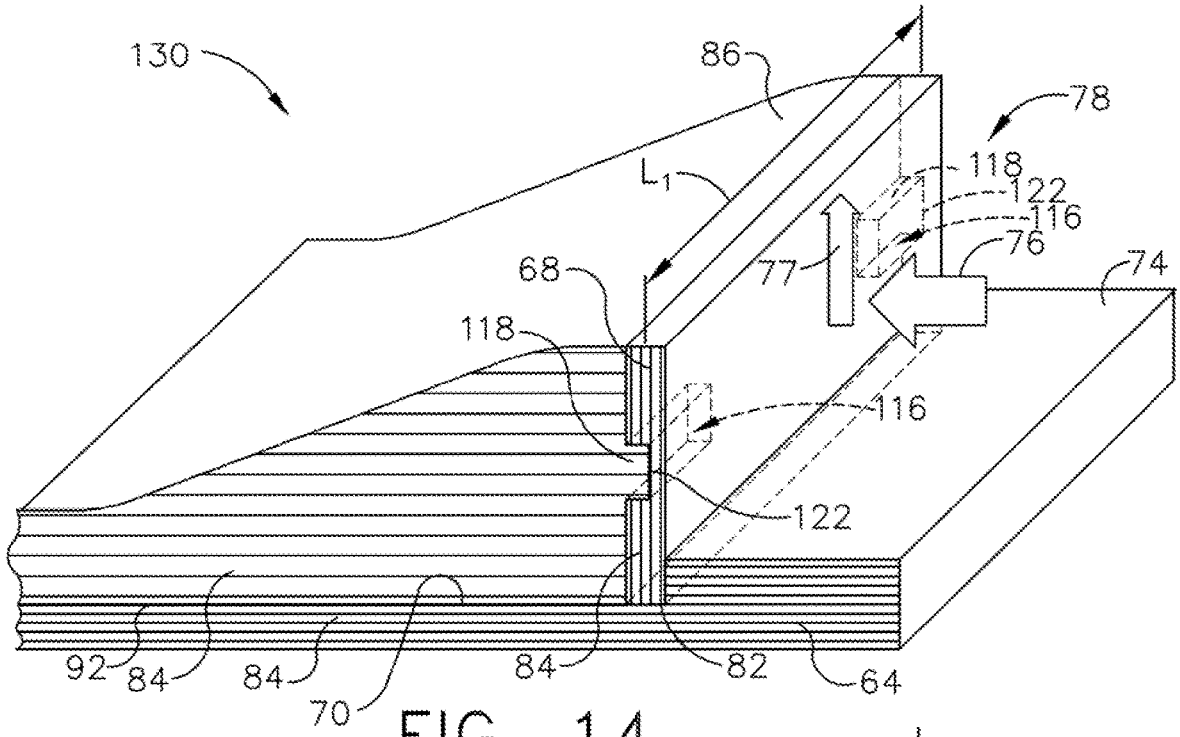
FIG. 14 is a schematic isometric view of another embodiment of the tabbed load bearing wall, in accordance with one or more embodiments shown or described herein.
Figure 15:
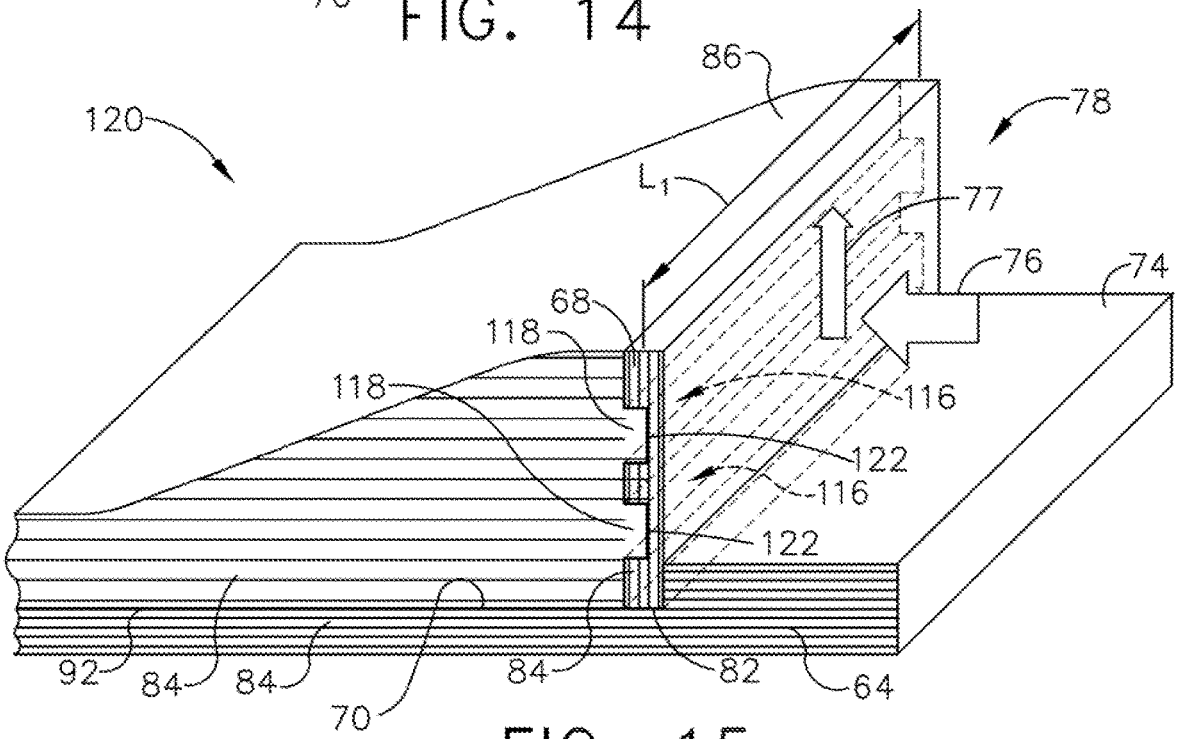
FIG. 15 is a schematic isometric view of the embodiment of FIG. 11, in accordance with one or more embodiments shown or described herein.

Referring now to FIGS. 10-15, illustrated are a plurality of embodiments of a band, referenced 115, 120, 125, 130 respectively, comprised of a plurality of subcomponents and the joining of the subcomponents to form a portion of a larger component structure, and more particularly a nozzle, such as nozzle 34 of FIG. 1. FIGS. 10 and 12 illustrate an embodiment in simplified sectional view and a simplified isometric view, respectively. FIGS. 11 and 15 illustrate another embodiment in simplified sectional view and a simplified isometric view, respectively. FIGS. 13 and 14, illustrated additional tabbed embodiments in simplified isometric views.

Similar to the previous embodiments, it should be noted that in the embodiments illustrating and describing the bands 115, 120 that only a portion of the respective band is illustrated. In each of the embodiments of FIGS. 10-15, a separate and discrete wall support 86 is disposed within a recess 92 formed in a surface 70 of the band flowpath 64 to provide support to the load bearing wall 68. In the embodiments of FIGS. 10-15, illustrated is a load bearing wall 68 being joined thereto the band flowpath 64 and a respective wall support 86 at an interlocking mechanical joint 78. The load bearing wall is disposed in a recess 82 formed into the surface 70 of the band flowpath 64. Accordingly, the band flowpath 64, and more particularly the overhang 74, provides direct lateral support to the load bearing wall 68. In an alternate embodiment, the load bearing wall 68 and the discrete wall support 86 are disposed on a surface 70 of the band flowpath 64, and may include a secondary wall support, as previously described with respect to FIGS. 6 and 9 to provide additional support to the load bearing wall 68.

In contrast to the previously disclosed embodiments, in the illustrated embodiments of FIGS. 10-15, the load bearing wall 68 and the discrete wall support 86 include one or more cooperatively engaged interlocking features 116 that provide for additional interlocking means at the interlocking mechanical joint 78. More particularly, in each of the embodiments the discrete wall support 86 includes one or more tabs 118, each configured to cooperatively engage with one or more recesses 122 formed in the load bearing wall 68. In the embodiment of FIGS. 10 and 12, the discrete wall support 86 includes a single tab 118, and the load bearing wall 68 includes a cooperative single recess 122, each extending a substantial length "$L_1$" (FIGS. 12-15) of the load bearing wall 68 and discrete wall support 86. In the embodiment of FIGS. 11 and 15, the discrete wall support 86 includes a plurality of tabs 118, and the load bearing wall 68 includes a plurality of cooperative recesses 122, each extending the substantial length "$L_1$" of the load bearing wall 68 and discrete wall support 86. Illustrated in FIGS. 13 and 14 are embodiments of the band, referenced 125 and 130, respectively. The bands 125 and 130 each include the discrete wall support 86 including a plurality of tabs 118 and the load bearing wall 68 including a plurality of cooperative recesses 122. In contrast to the embodiments of FIGS. 10, 11, 12 and 15, each of the tabs 118 and cooperating recesses 122 extend only a partial length of the load bearing wall 68 and wall support 86.

In the illustrated embodiments of FIGS. 10-15, the band flowpath 64, the load bearing wall 68 and the discrete wall support 86, including the one or more tabs 118, are formed of a ceramic matrix composite (CMC) including reinforcing fibers 84 embedded in a matrix. In an alternate embodiment, at least one of the band flowpath 64, the load bearing wall 68 and the discrete wall support 86, including the one or more tabs 118, are formed as a ceramic monolithic subcomponent. As illustrated in FIGS. 10-15, the band flowpath 64, the load bearing wall 68 and the discrete wall support 86 are illustrated joined one to the other at the interlocking mechanical joint 78.

In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68 and the discrete wall support 86 are not connected by fibers 84 as none of the fibers 84 bridge the interlocking mechanical joint 78. The fibers 84 in the load bearing wall 68 are oriented substantially normal to the fibers 84 in the band flowpath 64 and the discrete wall support 86 and thus would need to break in order for the load bearing wall 68 to fail under loading 76.

In this manner, the interlocking mechanical joint 78 has toughness in the loading direction.

Figure 16:
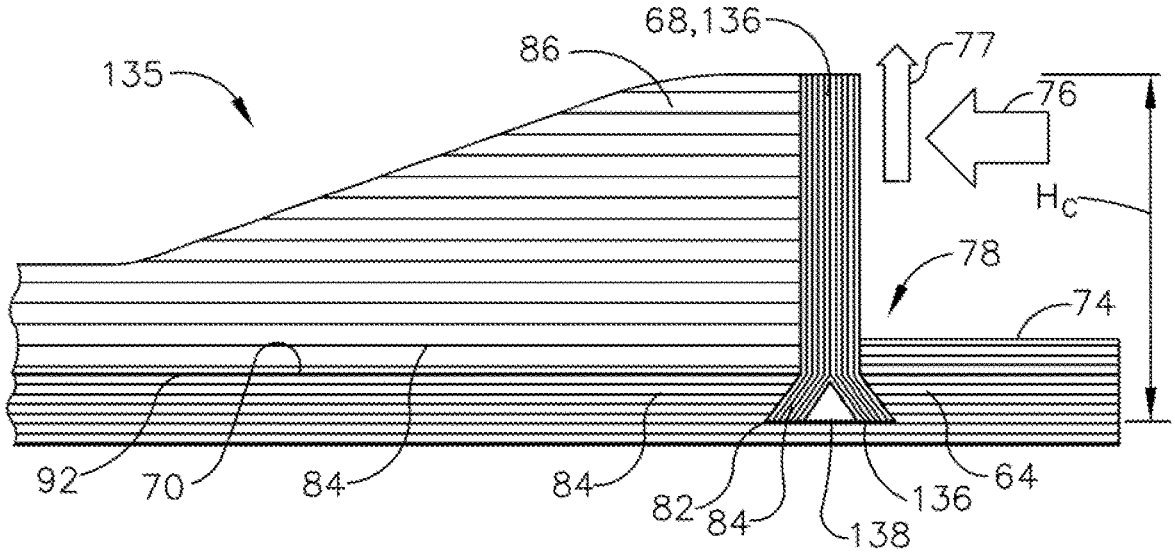
FIG. 16 is a schematic sectional view illustrating another embodiment of a portion of load bearing component, in accordance with one or more embodiments shown or described herein.

Referring now to FIG. 16, illustrated in simplified sectional view is an another embodiment of band 135 comprised of a plurality of subcomponents and the joining of the subcomponents to form a portion of a larger component structure, and more particularly a nozzle, such as nozzle 34 of FIG. 1. It should be noted that in the embodiment illustrating and describing the band 135 that only a portion of the band 135 is illustrated. In the embodiment of FIG. 16, illustrated is a load bearing wall 68 being joined thereto the band flowpath 64 at an interlocking mechanical joint 78. In the embodiments of FIG. 16, illustrated is a load bearing wall 68 being joined thereto the band flowpath 64 and the discrete wall support 86 at an interlocking mechanical joint 78. In this particular embodiment, the load bearing wall 68 is a dove-tailed shaped load bearing wall 136, configured having a dovetail shaped portion that is disposed within a recess 82, having a cooperatively formed geometry, formed in a surface 70 of the band flowpath 64 to provide support to the dove-tailed shaped load bearing wall 136. The discrete wall support 86 is illustrated as formed as a discrete and separate component disposed in a recess 92 formed into the surface 70 of the band flowpath 64 to provide support to the dove-tailed shaped load bearing wall 136 along a complete height "$H_c$" of the dove-tailed shaped load bearing wall 136. In an alternate embodiment, the discrete wall support 86 provides support to the dove-tailed shaped load bearing wall 136 along only a partial height of the dove-tailed shaped load bearing wall 136. As illustrated, the band flowpath 64, and more particularly the overhang 74 and the wall support each provide direct lateral support to the dove-tailed shaped load bearing wall 136. In an alternate embodiment, the discrete wall support 86 is disposed on a surface 70 of the band flowpath 64, and may include a secondary wall support, as previously described with respect to FIGS. 6 and 9 to provide additional support to the dove-tailed shaped load bearing wall 136.

In the illustrated embodiment of FIG. 16, the band flowpath 64, the dove-tailed shaped load bearing wall 136 and the discrete wall support 86 are formed of a ceramic matrix composite (CMC) including reinforcing fibers 84 embedded in a matrix. In an alternate embodiment, at least one of the band flowpath 64, the dove-tailed tailed shaped load bearing wall 136 and the discrete wall support 86 are formed as a ceramic monolithic subcomponent. As illustrated in FIG. 16, the band flowpath 64, the dove-tailed shaped load bearing wall 136 and the discrete wall support 86 are illustrated joined one to the other at the interlocking mechanical joint 78.

As best illustrated in FIG. 16, in an embodiment, the dove-tailed shaped load bearing wall 136 may include an optional noodle insert 138 as discussed in U.S. patent application bearing Ser. No. 15/878,687, by Feie, B. et al., filed on Jan. 24, 2018, and titled, "COMPOSITE COMPONENTS HAVING T OR L-JOINTS AND METHODS FOR FORMING SAME" which is incorporated herein in its entirety.

In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68 and the discrete wall support 86 are not connected by fibers 84 as none of the fibers 84 bridge the interlocking mechanical joint 78. The fibers 84 in the load bearing wall 68 are oriented substantially normal to the fibers 84 in the band flowpath 64 and the discrete wall support 86 and thus would need to break in order, and/or shear away portions of the dovetail shaped portion 136, for the load bearing wall 68 to fail under loading 76. In this manner, the interlocking mechanical joint 78 has toughness in the loading direction.

Figure 17:
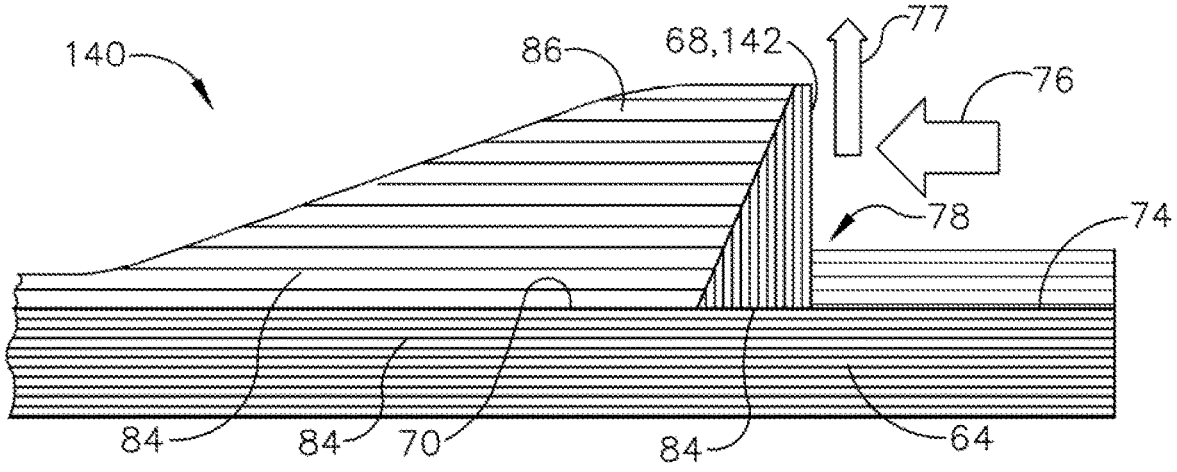
FIG. 17 is a schematic sectional view illustrating another embodiment of a portion of load bearing component, in accordance with one or more embodiments shown or described herein.
Figure 18:
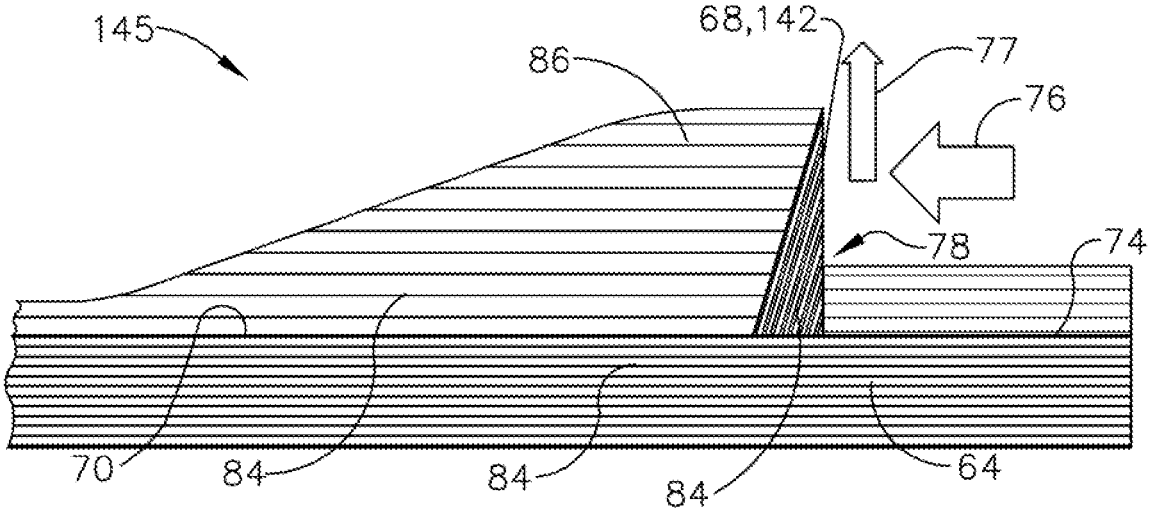
FIG. 18 is a schematic sectional view illustrating another embodiment of a portion of load bearing component, in accordance with one or more embodiments shown or described herein.

Referring now to FIGS. 17 and 18, illustrated in simplified sectional views are embodiments of a band 140, 145, respectively, comprised of a plurality of subcomponents and the joining of the subcomponents to form a portion of a larger component structure, and more particularly a nozzle, such as nozzle 34 of FIG. 1. Only a portion of the bands 140, 145 are illustrated. In the embodiments of FIGS. 17 and 18, illustrated is a load bearing wall 68 being joined thereto the band flowpath 64 and the discrete wall support 86 at an interlocking mechanical joint 78. Similar to the embodiments of FIGS. 6 and 8, in this particular embodiment, the band flowpath 64 does not provide any direct lateral support to the load bearing wall 68. In this embodiment, a separate and discrete wall support 86 is disposed on a surface 70 of the band flowpath 64 to provide support to the load bearing wall 68. In addition, in this particular embodiment, a secondary wall support 96 is positioned on an uppermost surface 75 of the overhang 74. The secondary wall support 96 provides additional support to the load bearing wall 68 on the load side. In contrast to the previously disclosed embodiments, the load bearing wall support 68 is configured having a wedge-shaped geometry, and references 142. In the embodiment of FIG. 17, the fibers 84 within the wedge-shaped load bearing wall support 142 are oriented substantially normal to the fibers 84 in the band flowpath 64 and the discrete wall support 86. In the embodiment of FIG. 18, the fibers 84 within the wedge-shaped load bearing wall support 142 are not oriented normal to or parallel with the fibers 84 in the band flowpath 64 and the discrete wall support 86.

In the illustrated embodiments of FIGS. 17 and 18, the band flowpath 64, the wedge-shaped load bearing wall 142 and the discrete wall support 86 are formed of a ceramic matrix composite (CMC) including reinforcing fibers 84 embedded in a matrix. In an alternate embodiment, at least one of the band flowpath 64, the wedge-shaped load bearing wall 142 and the discrete wall support 86 are formed as a ceramic monolithic subcomponent. As illustrated in FIG. 18, the band flowpath 64, the wedge-shaped load bearing wall 142 and the discrete wall support 86 are illustrated joined one to the other at the interlocking mechanical joint 78.

In response to the expected loading direction, as illustrated by arrow 76, failure of the interlocking mechanical joint 78 would require the wedge-shaped load bearing wall 68 to pull away from the band flowpath 64 (in the vertical direction as oriented in the figures) as indicated by reaction force 77. In an embodiment, the plurality of plies 88 forming the band flowpath 64, the wedge-shaped load bearing wall 68 and the discrete wall support 86 are not connected by fibers 84 as none of the fibers 84 bridge the interlocking mechanical joint 78. The fibers 84 in the wedge-shaped load bearing wall 68 are oriented substantially normal to the fibers 84 in the band flowpath 64 and the discrete wall support 86 and thus would need to break in order for the wedge-shaped load bearing wall 68 to fail under loading 76. In this manner, the interlocking mechanical joint 78 has toughness in the loading direction.

Figure 19:
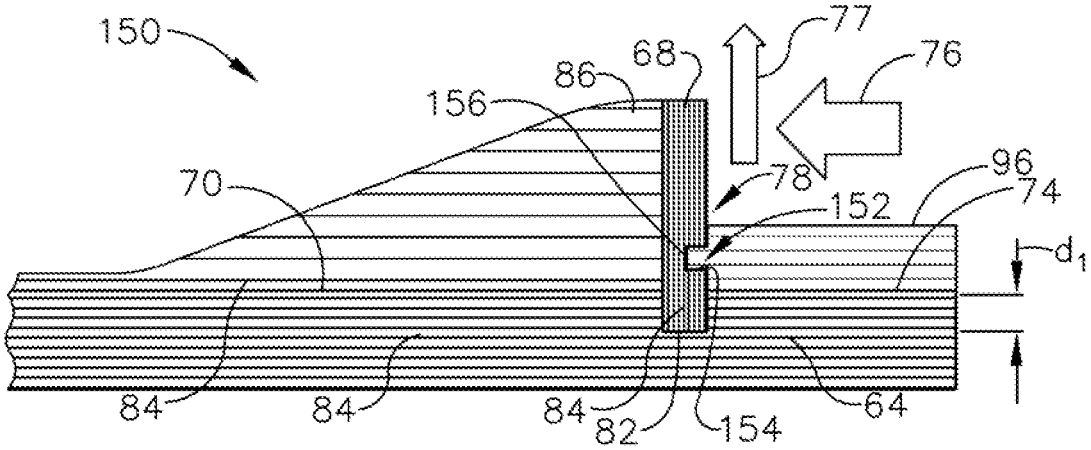
FIG. 19 is a schematic sectional view illustrating another embodiment of a portion of load bearing component, in accordance with one or more embodiments shown or described herein.

Referring now to FIG. 19, illustrated in simplified sectional view is an embodiment of a band 150 comprised of a plurality of subcomponents and the joining of the subcomponents to form a portion of a larger component structure, and more particularly a nozzle, such as nozzle 34 of FIG. 1. Only a portion of the band 150 is illustrated. In the embodiment of FIG. 19, illustrated is a load bearing wall 68 being joined thereto the band flowpath 64, the discrete wall support 86 and a secondary wall support 96 at an interlocking mechanical joint 78. In the embodiment of FIG. 19, a separate and discrete wall support 86 is disposed on a surface 70 of the band flowpath 64 to provide support to the load bearing wall 68. The load bearing wall 68 is disposed in a recess 82 formed into the surface 70 of the band flowpath 64. Accordingly, the discrete wall support 86 provides direct lateral support to the load bearing wall 68. The band 150 further includes a secondary wall support 96, as previously described with respect to FIGS. 6 and 9 to provide additional support to the load bearing wall 68 on the load side.

In contrast to the previously disclosed embodiments, in the illustrated embodiment of FIG. 19, the load bearing wall 68 and the secondary wall support 96 include one or more cooperatively engaged interlocking features 152 that provide for additional interlocking means at the interlocking mechanical joint 78. More particularly, the secondary wall support 96 includes one or more tabs 154, each configured to cooperatively engage with one or more recesses 156 formed in the load bearing wall 68. In the embodiment of FIG. 19, the secondary wall support 96 includes a single tab 154, and the load bearing wall 68 includes a cooperative single recess 156, each extending a substantial length of the load bearing wall 68 and the secondary wall support 96. In alternate embodiments, the secondary wall support 96 includes a plurality of tabs 154, and the load bearing wall 68 includes a plurality of cooperative recesses 156, each extending a substantial length and/or a partial length of the load bearing wall 68 and the secondary wall support 86, as similar described with regard to FIGS. 10-15.

In the illustrated embodiments of FIG. 19, the band flowpath 64, the load bearing wall 68, the discrete wall support 86 and the secondary wall support 96 are formed of a ceramic matrix composite (CMC) including reinforcing fibers 84 embedded in a matrix. In an alternate embodiment, at least one of the band flowpath 64, the load bearing wall 68, the discrete wall support 86 and the secondary wall support 96 are formed as a ceramic monolithic subcomponent. As illustrated in FIG. 19 the band flowpath 64, the load bearing wall 68, the discrete wall support 86 and the secondary wall support 96 are illustrated joined one to the other at the interlocking mechanical joint 78.

In response to the expected loading direction, as illustrated by arrow 76, failure of the interlocking mechanical joint 78 would require the load bearing wall 68 to pull away from the band flowpath 64 (in the vertical direction as oriented in the figures) as indicated by reaction force 77. In an embodiment, the plurality of plies 88 forming the band flowpath 64, the load bearing wall 68, the discrete wall support 86 and the secondary wall support 96 are not connected by fibers 84 as none of the fibers 84 bridge the interlocking mechanical joint 78. The fibers 84 in the load bearing wall 68 are oriented substantially normal to the fibers 84 in the band flowpath 64, the load bearing wall 68, the discrete wall support 86 and the secondary wall support 96 and thus would need to break in order for the load bearing wall 68 to fail under loading 76. In this manner, the interlocking mechanical joint 78 has toughness in the loading direction.

Figure 20:
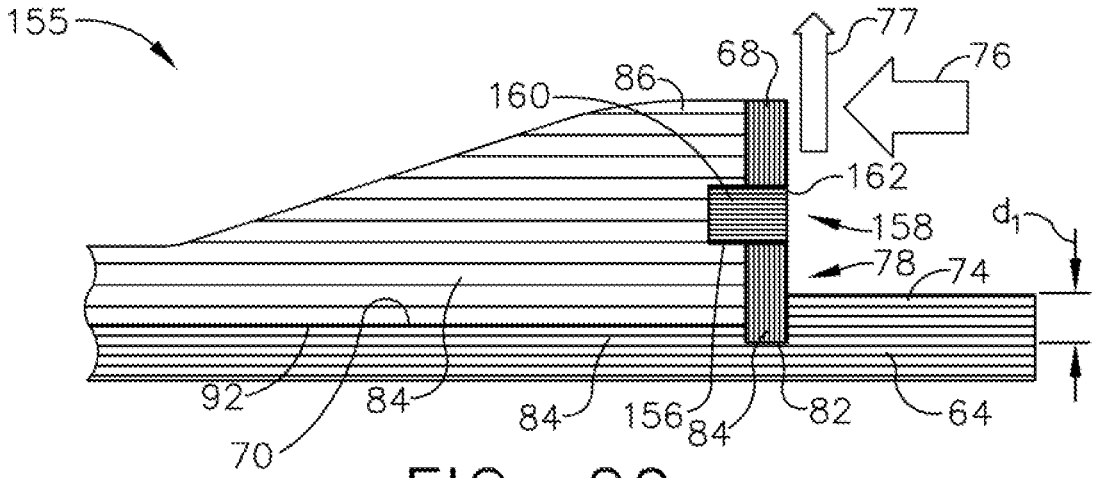
FIG. 20 is a schematic sectional view illustrating another embodiment of a portion of load bearing component, in accordance with one or more embodiments shown or described herein.

Referring now to FIG. 20, illustrated in simplified sectional view is an embodiment of a band 155 comprised of a plurality of subcomponents and the joining of the subcomponents to form a portion of a larger component structure, and more particularly a nozzle, such as nozzle 34 of FIG. 1. Only a portion of the band 155 is illustrated. In the embodiment of FIG. 20, illustrated is a load bearing wall 68 being joined thereto the band flowpath 64 and the discrete wall support 86 at an interlocking mechanical joint 78. In the embodiment of FIG. 20, a separate and discrete wall support 86 is disposed in a recess 92 of the band flowpath 64 to provide support to the load bearing wall 68. The load bearing wall 68 is disposed in a recess 82 formed into the surface 70 of the band flowpath 64. Accordingly, the discrete wall support 86 provides direct lateral support to the load bearing wall 68. In an alternate embodiment, the band 155 further includes a secondary wall support, as previously described with respect to FIGS. 6 and 9, to provide additional support to the load bearing wall 68 on the load side.

In contrast to the previously disclosed embodiments, in the illustrated embodiment of FIG. 20, the load bearing wall 68 includes one or more cooperatively engaged interlocking features that provide for additional interlocking means at the interlocking mechanical joint 78. In the embodiment of FIG. 20, the interlocking mechanical joint 78 includes at least one additional interlocking subcomponent 158, comprising at least one interlocking CMC pin 160, each disposed within to as to cooperatively engage with one of at least one receiving slot 162 formed in the load bearing wall 68 and within one of at least one recess 156 formed in the discrete wall support 86 in a manner so as to provide additional strength to the interlocking mechanical joint 78.

The at least one interlocking CMC pin 160 is generally similar to a "biscuit" in the woodwork joinery field. In the embodiment of FIG. 20, a single interlocking CMC pin 160 extends a length of the load bearing wall 68. In an alternate embodiment, a plurality of interlocking CMC pins 160 may be incorporated, each extending only a partial length of the load bearing wall. In the embodiment of FIG. 20, the interlocking CMC pin 160 may be inserted into a cooperating receiving slot 162 from an exterior of the band 155. In an embodiment, the at least one interlocking CMC pin 160, the cooperating receiving slot 162 and the recess 156 need not be configured with close tolerances when a matrix, such as glue, is utilized. In an alternate embodiment, the at least one interlocking CMC pin 160, the cooperating receiving slot 162 and the recess 156 are configured with close tolerances.

Figure 21:
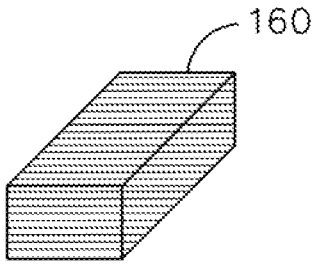
FIG. 21 is a simplified perspective view of a CMC pin for use in the embodiment of FIG. 20, in accordance with one or more embodiments shown or described herein.
Figure 22:
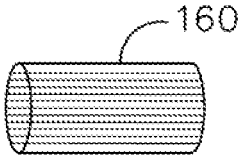
FIG. 22 is a simplified perspective view of another embodiment of a CMC pin for use in the embodiment of FIG. 20, in accordance with one or more embodiments shown or described herein.

In the illustrated embodiments, each of the interlocking CMC pins 160 is configured having a substantially rectangular shape, as best illustrated in FIG. 21, or a substantially cylindrical shape, as best illustrated in FIG. 22. In an alternate embodiment, the at least one interlocking CMC pin 160 may have any geometric shape, including but not limited to oval, round, trapezoidal, etc. One of the plurality of interlocking CMC pins 160 is disposed within the cooperating receiving slot 162 to engage the load bearing wall 68 in a manner so as to form the interlocking mechanical joint 78.

Figure 23:
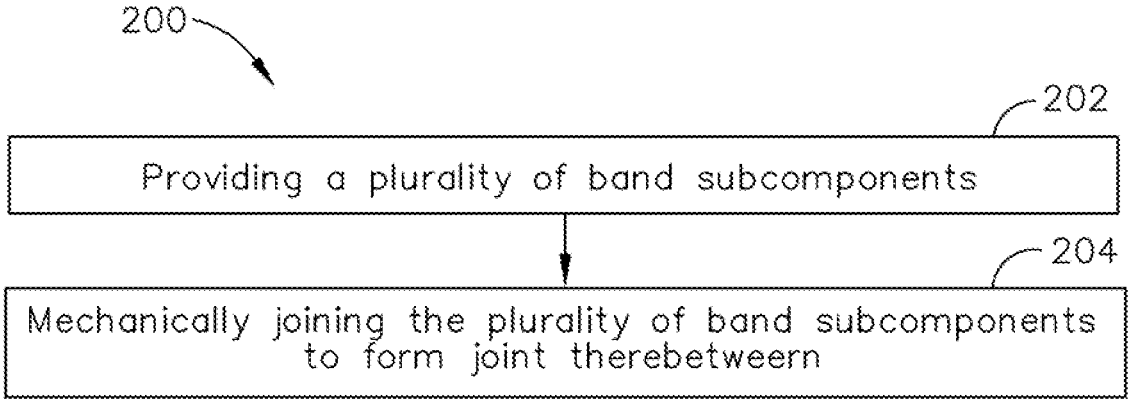
FIG. 23 illustrates a flowchart of a method for forming an interlocking mechanical joint for joining a plurality of subcomponents of a nozzle, in accordance with one or more embodiments shown or described herein.

FIG. 23 is a flowchart of a method 200 of forming a portion of a ceramic matrix composite (CMC) nozzle, in accordance with an embodiment disclosed herein. As shown in FIG. 23, the method 200 comprises providing a plurality of band subcomponents comprised of a ceramic matrix composite (CMC) including reinforcing fibers embedded in a matrix, in a step 202. As previously described, the plurality of reinforcing fibers are oriented along a length of the subcomponent.

The subcomponents are next mechanically joined one to the other at an interlocking mechanical joint, in a step 204, to form a portion of the nozzle. The at least one interlocking mechanical joint may be comprised according to any of the previously described embodiments. The subcomponents are joined one to the other in a manner to orient the reinforcing fibers of the load bearing wall substantially normal to the reinforcing fibers of the band flowpath. The interlocking mechanical joint is formed during a CMC manufacture process in one of an autoclave (AC) state, a burn out (BO) state, or melt infiltration (MI) state. In an embodiment, the interlocking mechanical joint may include direct bonding of the components together, or the components may be bonded by silicon, silicon carbide, a combination thereof, or other suitable material. The bonding material may be deposited as a matrix precursor material that is subsequently densified by MI, CVI, or PIP. Alternatively, the bonding material maybe produced by MI, CVI, or PIP without the use of matrix precursor in the interlocking mechanical joint. As previously noted, the interlocking mechanical joints described herein may be formed at any appropriate stage in CMC processing. That is, the interlocking subcomponents may be comprised of green prepreg, laminated preforms, pyrolyzed preforms, fully densified preforms, or combinations thereof.

Accordingly, described are the use of interlocking mechanical joints to join multiple subcomponents, and more specifically the use of interlocking mechanical joints, including one or more tabs, projections, recesses, reinforcing CMC pins, wherein the ceramic fibers that comprise the subcomponents or the interlocking means would need to be broken in order to separate the interlocking mechanical joint in an expected loading direction. While some existing interlocking mechanical joints behave in this manner, others do not and could fail by shearing the interlocking feature in the interlaminar direction. The interlocking mechanical joints as described herein provide for reinforcement of the subcomponents that make up the interlocking mechanical joint, without reinforcing the interlocking mechanical joint itself. This approach can greatly simplify the manufacturing process and prevent the property debits that can occur in a direction orthogonal to the reinforcement. The interlocking mechanical joining of the subcomponents as described herein can be done in the layed up state prior to lamination, in the autoclave (AC), burn out (BO), or melt infiltration (MI) state or combinations thereof of the CMC manufacture process. For joints made in the MI state, the interlocking mechanical joint maybe left "unglued". These joints may also be easier to repair. In an embodiment, simple shapes, such as flat panels, can be green machined (in autoclaved state) and assembled using woodworking type interlocking mechanical joints as described herein. In an embodiment, a CMC matrix precursor slurry (or variants thereof) may be used to bond or glue the CMC subcomponents together. Final densification and bonding occurs in the MI state.

While the invention has been described in terms of one or more particular embodiments, it is apparent that other forms could be adopted by one skilled in the art. It is understood that in the method shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceramic matrix composite (CMC) component for forming a portion of a nozzle for a gas turbine engine comprising:

a subcomponent comprised of a ceramic matrix composite (CMC) including reinforcing fibers embedded in a matrix;

a load bearing wall comprised of a ceramic matrix composite (CMC) including reinforcing fibers embedded in a matrix;

a wall support comprised of a ceramic matrix composite (CMC) including reinforcing fibers embedded in a matrix; and at least one joint joining the subcomponent, the load bearing wall and the wall support, wherein the reinforcing fibers of the load bearing wall are oriented normal to the reinforcing fibers of the subcomponent and the wall support.

2. The component of claim 1, wherein the wall support is integrally formed with the subcomponent.

3. The component of claim 1, wherein the wall support is separate and distinct from the subcomponent.

4. The component of claim 1, wherein the at least one joint is an interlocking joint comprising at least one tab defined in the wall support and cooperatively engaged with a respective at least one recess formed in the load bearing wall.

5. The component of claim 1, wherein the load bearing wall is configured as a dovetail shaped load bearing wall.

6. The component of claim 1, wherein the load bearing wall is configured as a wedge-shaped load bearing wall.

7. The component of claim 6, wherein the reinforcing fibers of the wedge-shaped load bearing wall are oriented normal to the reinforcing fibers in the subcomponent and the wall support.

8. The component of claim 1, further comprising a secondary wall support.

9. The component of claim 8, wherein the at least one joint is an interlocking joint comprising at least one tab defined in the secondary wall support and cooperatively engaged with a respective at least one recess formed in the load bearing wall.

10. The component of claim 1, wherein the at least one joint is an interlocking joint comprising at least one ceramic matrix composite (CMC) pin, each disposed in a slot in the load bearing wall and cooperatively engaged therewith.

11. The component of claim 1, wherein the load bearing wall is disposed in a recess formed in an uppermost surface of the subcomponent.

12. The component of claim 11, wherein the wall support is disposed in the recess formed in the uppermost surface of the subcomponent.

13. The component of claim 11, wherein the wall support is disposed on the uppermost surface of the subcomponent.

14. The component of claim 1, wherein the load bearing wall is disposed on an uppermost surface of the subcomponent.

15. The component of claim 14, wherein the wall support is disposed on the uppermost surface of the subcomponent.

16. A portion of a nozzle for a gas turbine comprising:

a band comprising:

a band flowpath comprised of a ceramic matrix composite (CMC) including reinforcing fibers embedded in a matrix, the band flowpath having an opening defined therein;

a load bearing wall comprised of a ceramic matrix composite (CMC) including reinforcing fibers embedded in a matrix;

a wall support comprised of a ceramic matrix composite (CMC) including reinforcing fibers embedded in a matrix; and at least one joint joining the band flowpath, the load bearing wall and the wall support to form a portion of a CMC component, wherein the reinforcing fibers of the load bearing wall are oriented normal to the reinforcing fibers of the band flowpath and the wall support.

17. The nozzle of claim 16, wherein the at least one joint is an interlocking joint comprising one or more tabs defined in the wall support and cooperatively engaged with a response one or more recesses formed in the load bearing wall.

18. The nozzle of claim 16, further comprising a secondary wall support.

19. The nozzle of claim 18, wherein the at least one joint is an interlocking joint comprising one or more tabs defined in the secondary wall support and cooperatively engaged with a respective one or more recesses formed in the load bearing wall.

20. The nozzle of claim 16, wherein the at least one joint is an interlocking joint comprising a dove-tailed shaped load bearing wall cooperatively engaged with a respective recess formed in the band flowpath.

21. The nozzle of claim 16, wherein the at least one interlocking joint comprises a wedge shaped load bearing wall.

22. The nozzle of claim 16, wherein the at least one joint is an interlocking joint comprising at least one ceramic matrix composite (CMC) pin, each disposed in a slot in the load bearing wall and cooperatively engaged therewith.

23. A method of forming a ceramic matrix composite (CMC) component for forming a portion of a nozzle for a gas turbine engine comprising:

providing a subcomponent comprised of a ceramic matrix composite (CMC) including reinforcing fibers embedded in a matrix;

providing a load bearing wall comprised of a ceramic matrix composite (CMC) including reinforcing fibers embedded in a matrix;

providing a wall support comprised of a ceramic matrix composite (CMC) including reinforcing fibers embedded in a matrix; and mechanically joining the subcomponent, the load bearing wall and the wall support to form a portion of a CMC component and to form at least one mechanical joint, wherein the reinforcing fibers of the load bearing wall are oriented normal to the reinforcing fibers of the subcomponent and the wall support.

* * * * *